United States Patent [19]

Van Dusen et al.

[11] 3,990,067

[45] Nov. 2, 1976

[54] ELECTRONIC SECURITY TOUR SYSTEM

[75] Inventors: Charles Harrison Van Dusen, Boulder Creek; Bruno Kaiser, Santa Cruz, both of Calif.

[73] Assignee: Sentry Technology Incorporated, Santa Cruz, Calif.

[22] Filed: Sept. 30, 1974

[21] Appl. No.: 510,317

[52] U.S. Cl. ..... 340/306; 340/312; 340/286

[51] Int. Cl.[2] ..... G08B 25/00

[58] Field of Search ..... 340/306, 147 R, 149 R, 340/149 A, 223, 286, 312

[56] References Cited

UNITED STATES PATENTS

| | | | |
|---|---|---|---|
| 3,466,605 | 9/1969 | Schoenwitz | 340/151 |
| 3,573,620 | 4/1971 | Ashley | 340/306 X |
| 3,736,561 | 5/1973 | Rumpel | 340/306 |
| 3,781,845 | 12/1973 | Ellul | 340/306 |
| 3,806,882 | 4/1974 | Clarke | 340/149 R |
| 3,848,229 | 11/1974 | Perron | 340/149 R |
| 3,860,911 | 1/1975 | Hinman | 340/149 R |
| 3,872,435 | 3/1975 | Cestaro | 340/149 R |

*Primary Examiner*—John W. Caldwell
*Assistant Examiner*—William M. Wannisky
*Attorney, Agent, or Firm*—Flehr, Hohbach, Test, Albritton & Herbert

[57] ABSTRACT

Apparatus for use in establishing a security system having a tour route which is followed by a guard, and having a plurality of tour stations spaced along the tour route. An electronic tour key is carried by the guard to each of the tour stations on the tour route for plug-in electrical connection therewith. Address codes are set in the tour stations and the electronic tour key for identifying a specified tour route and specific stations along the tour route. A tour information signal is generated by the electronic tour key after plug-in electrical connections have been made with a predetermined number of tour stations. The tour information signal is connected to a means for receiving such signals and for transmitting security information to a remote monitoring station. Programming and verifying means are provided for setting predetermined tour station address codes and for subsequently verifying tour station address codes and address codes which have been preset in the electronic tour key.

30 Claims, 19 Drawing Figures

ELECTRONIC SECURITY TOUR SYSTEM

BACKGROUND OF THE INVENTION

This invention relates to electronic security tour systems and more particularly to such security tour systems utilizing an electronic tour key which may be configured for either sequential or random electrical connections to a plurality of tour stations together with means for programming address codes in the tour stations and for verifying address codes in the electronic tour key and the tour stations.

Security tour systems in the past have involved mechanical engagement between a device carried by a tour guard and fixed tour stations for recording the time at which a guard passes a particular station. Such systems, in their more sophisticated forms, may involve a transmission line for connecting a security indication signal to a remote monitoring station upon proper performance by the guard of his tour, or upon improper performance by the guard of his tour, depending upon whether the system is a delinquency or direct reporting system. Some prior art systems are subject to tour abbreviation by guard personnel to the detriment of the security philosophy intended by installation of the security tour system.

There is therefore a need for a system which requires specific performance by a tour guard within a predetermined period of time, which performance is automatically monitored by a means for receiving information related to such performance and which may transmit information related thereto to a remote monitoring system. Means are also needed for setting and verifying tour station and tour key address codes.

SUMMARY AND OBJECTS OF THE INVENTION

A security monitoring system of the type having a predetermined tour route which is traveled by a security guard and which provides an output which may be connected to a remote monitoring station has an electronic tour key for electrical plug-in connection with each of the plurality of tour stations spaced along the tour route. Address codes are programmed in each of the tour stations and a matching address code is contained in the electronic tour key for each of the tour stations on the tour route. The electronic tour key provides a tour information signal when plug-in electrical connection has been made with a predetermined number of tour stations with matching address codes. Means are provided for receiving the tour information signal within a predetermined time window and for providing security indicators for transmission to the remote monitor station. Programming means are provided for setting the address codes in the tour stations and for verifying the address codes in the tour stations and the electronic tour key.

It is an object of the present invention to provide an electronic security tour system requiring a predetermined tour performance by a security tour guard within a predetermined period of time and providing information indicative of the tour performance.

Another object of the present invention is to provide an electronic security tour system which may not be tampered with by unauthorized persons.

It is another object of the present invention to provide an electronic security tour system in which the tour station codes and the electronic tour key codes may be readily checked.

It is another object of the present invention to provide an electronic security tour system requiring a predetermined sequence of plug-in electrical connections among the plurality of tour stations on the tour route.

Another object of the present invention is to provide ann electronic security tour system in which plug-in electrical connection may be made at each of the plurality of tour stations on the tour route in a random sequence by the security guard.

It is another object of the present invention to provide an electronic security tour system in which the tour stations may have tour station address codes readily programmed therein using external means.

It is another object of the present invention to provide an electronic security tour system having an electronic tour key which indicates when plug-in electrical connection at a tour station is properly or improperly made.

Another object of the present invention is to provide an electronic security tour system in which the electronic tour key is reset at the end of the tour route.

Additional objects and features of the invention will appear from the following description in which the preferred embodiment has been set forth in detail in conjunction with the accompanying drawings.

DESCRIPTION OF THE PREFERRED EMBODIMENTS

An electronic security tour system is disclosed which ensures the integrity of a security guard tour. An electronic tour key is carried by a guard and is encoded by the various tour stations on a tour route, accumulating the number of tour stations which have been entered into the electronic tour key. Any of the intermediate tour stations may be active, for reporting tour progress, but may be passive if no report of tour progress is required at that point. The last tour station on the tour route will reset the electronic tour key as well as providing a tour information signal to a tour information receiver an alarm transmitter. The tour information transmitter may be used for reporting security tour progress or exceptions to a remote security monitoring station.

Figure 1:
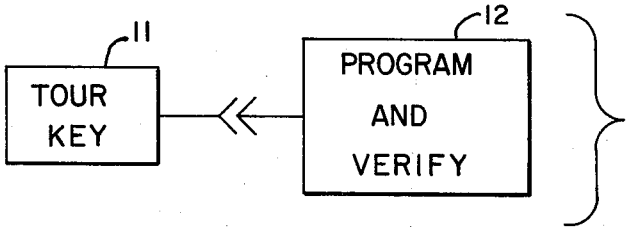
FIG. 1 is a block diagram of a tour key and a key address code verifier.

Referring to FIG. 1 an electronic tour key 11 is shown for electrical connection with a programmer and verifier 12. The verifier 12 may be encoded for the tour access code and the length of tour code of the electronic tour key 11 and then stepped through an entire security tour by the verifier 12 without having to go around the tour physically to verify the operational integrity of the electronic tour key 11.

Figure 2:
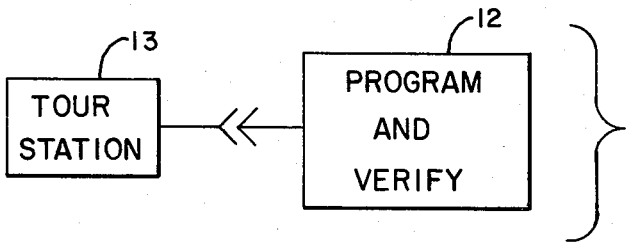
FIG. 2 is a block diagram of a tour station and a tour station address code programmer and verifier.

Referring to FIG. 2 a tour station 13 is shown for electrical connection with the programmer and verifier 12. In initial organization of a security tour route, each of the tour stations 13 must be programmed to become a particular coded part of the tour route. Programmer and verifier 12 electrically cuts the tour station address code into the tour station in the form of a six or eight bit code allowing for tours of up to 16 stations in length and between four and 16 discrete tour access codes for allowing parallel tours that must be serviced by security guards carrying electronic tour keys 11 having specific tour access codes programmed therein.

Figure 3:
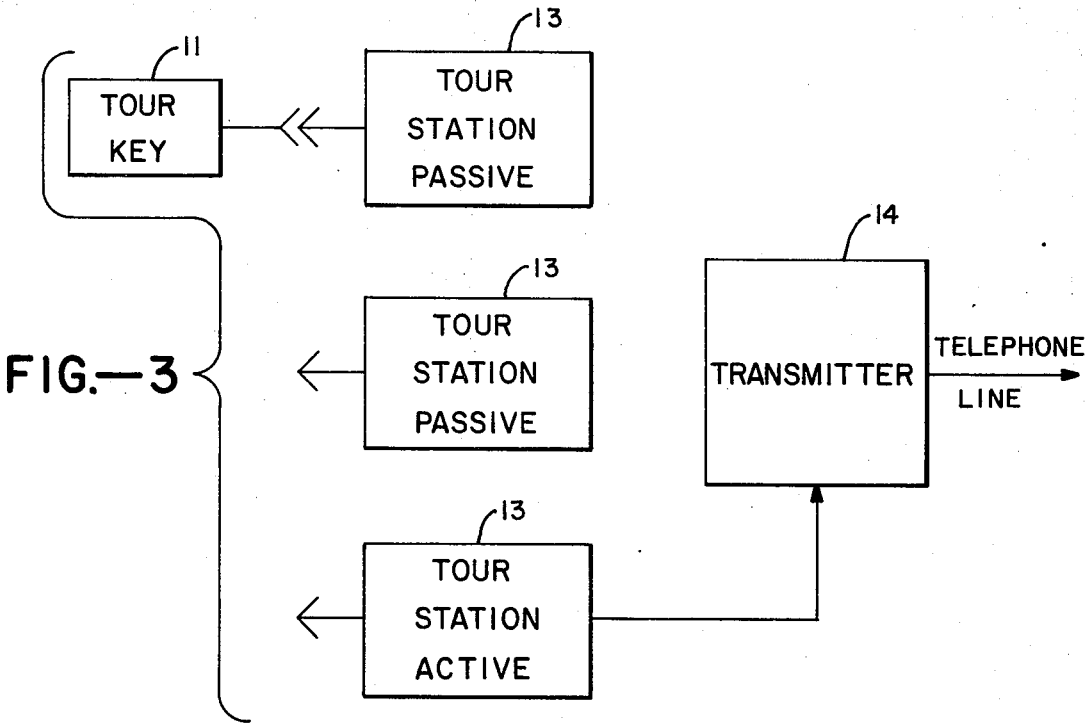
FIG. 3 is a block diagram of an electronic security tour system.

Referring to FIG. 3 the interaction of the system components can be described. The electronic tour key 11 is configured for plug-in electrical connection with each of the tour stations 13 as hereinafter described. A plurality of tour stations 13 is spaced along a security tour route and may include two types of tour stations 13, active and passive. Most of the tour stations 13 on a given tour will be of the passive type and will simply encode the electronic tour key 11 as the security guard makes his rounds performing electrical plug-in connections with each tour station 13. There is the possibility that any intermediate tour station 13 may be an active station which may transmit a tour information signal for providing a direct report through a tour information receiver and alarm transmitter 14 to a remote security monitoring station (not shown) or it may be a delinquency reporting station which provides a tour information signal to the tour information receiver and alarm transmitter for providing a security indication to the remote security monitoring station only for those times when the security guard has not conformed to the tour schedule.

Figure 4:
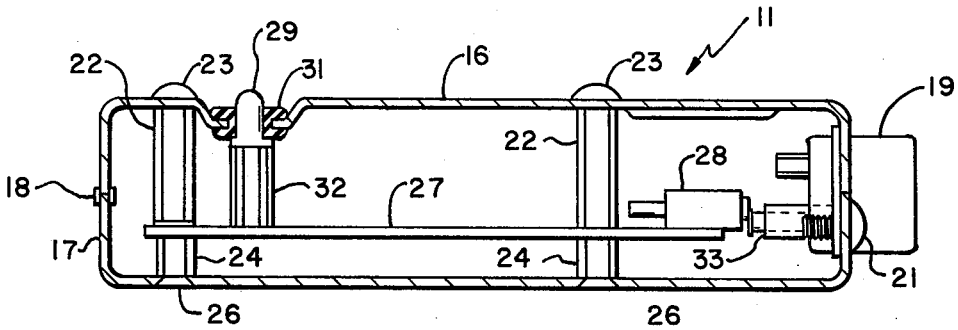
FIG. 4 is an elevation sectional view of an electronic tour key.

FIG. 4 shows an electronic tour key in section having an upper case section 16 and a lower case section 17 and a sealing band 18 at the junction of the case sections. An electrical connector 19 for plug-in electrical connection with other components in the system in mounted on the front of the assembled upper and lower case sections 16 and 17 by tamper-proof screws 21. Four stand-offs 22 are arranged adjacent to the inside of upper case section 16 for receiving tamper-proof screws 23. Four additional stand-offs 24 are arranged adjacent to the inside of lower case section 17 for studs 26. A printed circuit board 27 is supported between stand-offs 22 and 24. A "read" switch 28 is mounted on printed circuit board 27. A pair of light emitting diodes 29 are mounted in rubber grommets 31 positioned in upper case section 16 and are electrically connected through leads 32 to the printed circuit board 27. A spring loaded plunger 33 is provided for actuating "read" switch 28 when electrical connector 19 is plugged into a mating connector on other components in the system.

Figure 5:
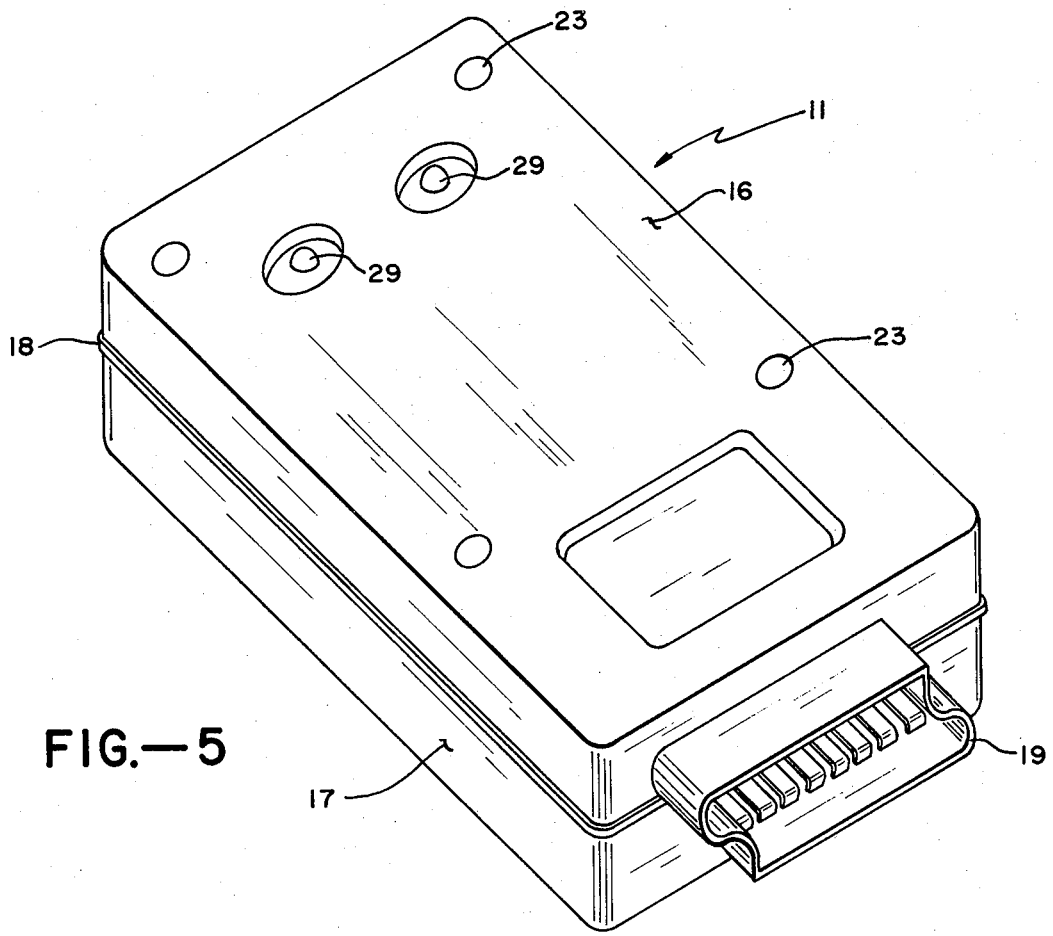
FIG. 5 is an isometric view of an electronic tour key.

FIG. 5 shows the electronic tour key external configuration with light emitting diodes 29 visible from the top of upper case section 16.

Figure 6:
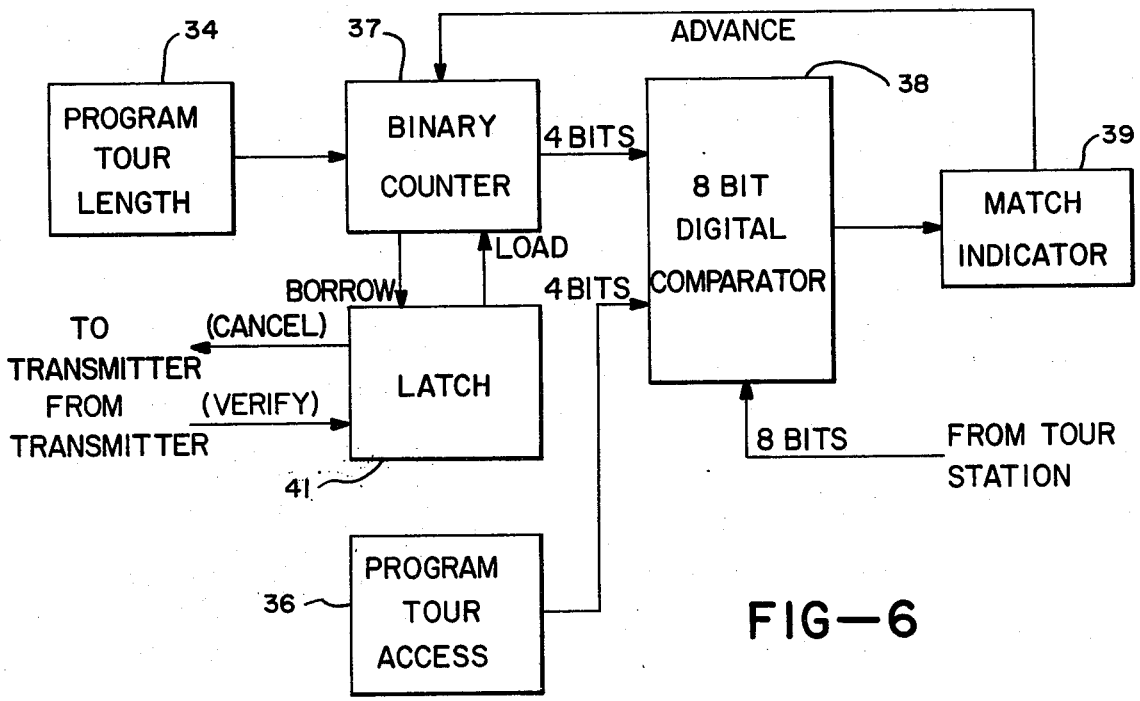
FIG. 6 is a block diagram of an electronic tour key.

FIG. 6 shows a block diagram of one embodiment of the electronic tour key 11. This embodiment requires that the tour stations 13 on a security tour route be approached for electrical plug-in connection in a predetermined sequence or order. The tour length program means 34 and a tour access program means 36 are provided. A binary counter 37 receives the tour length program from program means 34. Binary counter 37 provides a four bit binary number to an eight bit digital comparator 38. Eight bit digital comparator 38 also receives a four bit digital number from four tour access program means 36. Two digital numbers of four bits each are received from tour station 13 upon electrical plug-in connection therewith which are also connected to eight bit digital comparator 38. Digital comparator 38 provides an output dependent upon the comparison of the tour access code in the electronic tour key 11 with the tour access code in the tour station 13, and comparison of the digital output from binary counter 37 with the preset tour station code in tour station 13. The output of digital comparator 38 is connected to a match indicator 39 which energizes one of the light emitting diodes 29 for indicating either a match or no match between the tour station and the electronic tour key address codes. Match indicator 39 provides an advance signal upon withdrawal of electrical connector 19 from plug-in electrical connection with a tour station 13 if a match indication has occurred. The advance signal is connected to binary counter 37 for advancing to the next tour position code.

A latch 41 is included in electronic tour key 11 for actuation by a borrow signal from binary counter 37 when the digital output has counted down through zero. An input path is provided to latch 41 for resetting the latch to reload the tour length from tour length program means 34 into the binary counter 37.

Referring to the electrical schematic diagram of FIG. 7 the manner in which the plurality of key address codes is selected and the functional characteristics within electronic tour key 11 will be described. Tour length program means 34 are shown as switches S1 through S4. A tour length is set as a binary number by closing one of the switches S1 through S4 for a binary zero and leaving the switch open for a binary 1. For example, a binary 8 may be set in tour length program means 34 by closing switches S1, S2 and S3 while leaving switch S4 open. Switch S4 represents in this embodiment the most significant bit and it may be seen that binary 8 is encoded in the electronic tour key 11 as the tour length code. This will allow a nine station tour since binary counter 37 is utilized in a countdown mode and must count through zero. The tour access code is connected to four bits of the comparator 37*a* shown as ML4 in FIG. 7. A tour access code is set at tour access program means 36 by means of switches S5 through S8. A tour access code of binary 9, for example, may be set at tour accesss program means 36 by leaving switches S5 and S8 open and closing switches S6 and S7. In this embodiment switch S5 dictates the state of the least significant bit in the tour access code. These switches S1 through S8 are set by a person having the responsibility of determining the length of the security tour. These switches are set once when determining the tour length and tour access code and are sealed when the upper and lower case sections 16 and 17 are assembled in place on the electronic tour key 11.

Input data comes into the electronic tour key 11 through electrical connector 19 having multiple pins. Tour station sequence information comes in on pins 5, 6, 7 and 8, of connector 19, and tour station tour access information comes in on pins 1, 2, 3 and 4 of connector 19.

Figure 7:
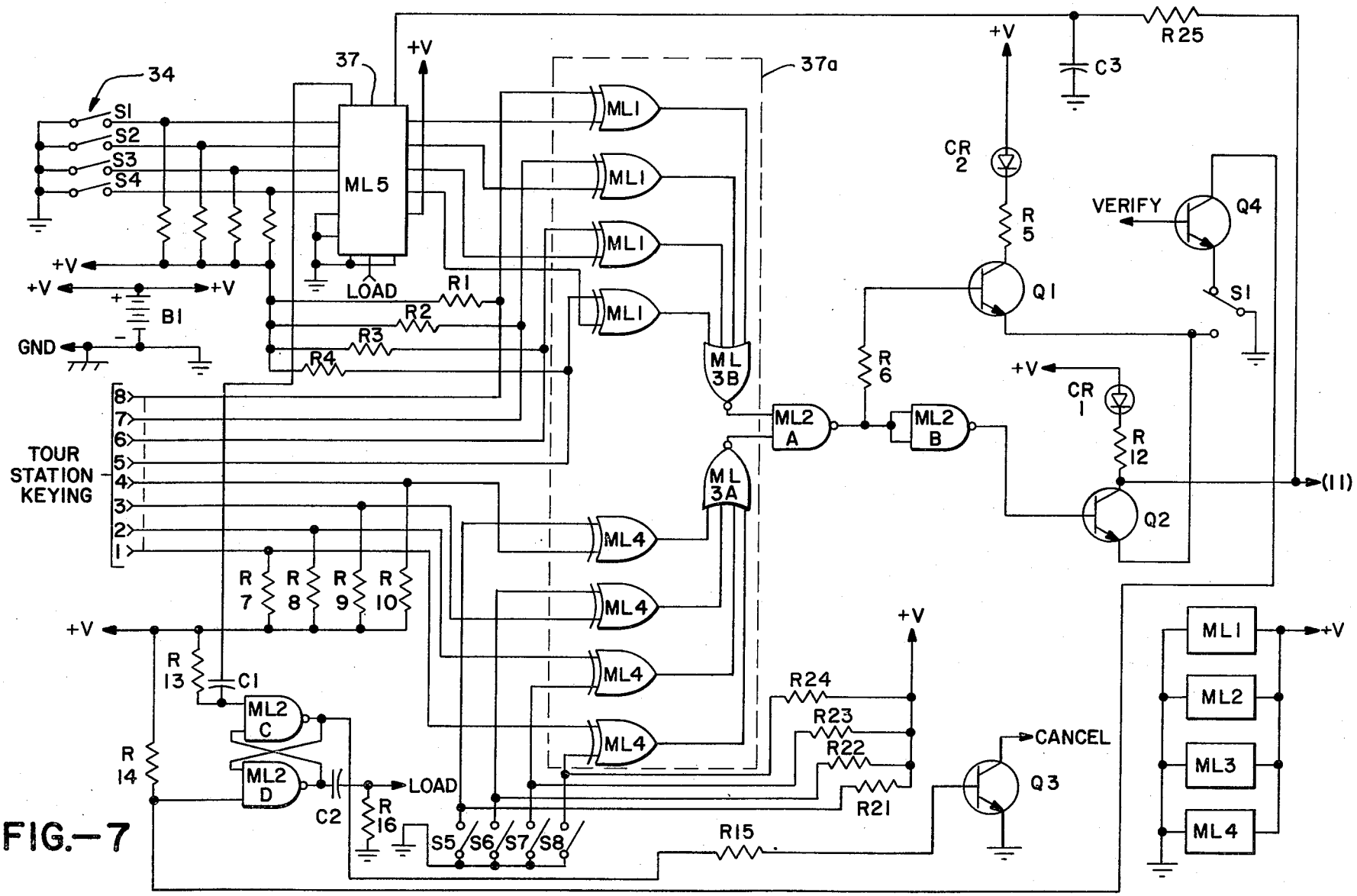
FIG. 7 is an electrical schematic diagram of an electronic tour key.

As further seen in FIG. 7 the tour station tour access code is placed on four exclusive OR gates ML4 and compared in pairs with the pre-programmed tour access code set at tour access program means 36. If these bit pairs agree then the function of the exclusive OR gates produces a logical 0 output when the pairs agree and a logical 1 output when members of each pair are dissimilar. These four logic outputs are presented to NOR gate ML3, section A, which will provide a logical 1 output if all of the tour access bit pairs have agreed. In such a case the proper tour key for the tour of which this tour station 13 is a part is being used and the other determination as to whether the proper tour station sequence is encoded in the tour station 13 is then determined.

Once the tour length code has been loaded into binary counter 37 a digital output in binary form appears at the output thereof. The tour station sequence code comes into the electronic tour key 11 on pins 5 through 8 and is connected to a second set of four exclusive OR gates ML1. The digital output of binary counter 37 is also connected digit by digit to separate ones of the four exclusive OR gates ML1. As described above for the array of exclusive OR gates ML4 if the inputs agree each exclusive OR gate would produce an output which is logical 0. If all four outputs are logical 0 then NOR gate ML3, Section B, will produce a logical 1 output. The outputs of OR gates ML3, Sections B and A, are connected to the input of NAND gate ML2, Section A. If the inputs to NAND gate ML2, Section A, are logical 1 an output logical 0 is obtained. The output of NAND gate ML2, Section A, is connected to the inputs of NAND gate ML2, Section B. A pair of logical 0 inputs will produce a logical 1 output to the base of transistor Q2. When electrical connector 19 is inserted into the mating connector on a tour station 13 switch S1 is mechanically actuated to place the emitter of transistor Q2 at ground. A logical 1 at the base of transistor Q2 will therefore cause the transistor to conduct passing current through light emitting diode CR1, which is green in color indicating that the codes in the tour station 13 and the electronic tour key 11 match.

It may be seen that if any of the input bit pairs to any of the sections of exclusive OR gates ML1 and ML4 are dissimilar a logical 1 output will result. This will produce a logical 0 at either or both of the outputs of NOR gates ML3, Sections A and B. A logical 0 at either of the inputs of NAND gate ML2, Section A, will produce a logical 1 output at the base of transistor Q1. As described above when electronic tour key 11 is inserted into the mating connector on a tour station 13 S1 grounds the emitter of transistor Q1. Transistor Q1 then conducts energizing light emitting diode CR2, which may be red in color to indicate a mismatch at some point in the compared tour access or tour length codes. It may also be seen that a pair of logical 1 inputs to NAND gate ML2, Section B, will provide a logical 0 output to the base of transistor Q2 maintaining it in a non-conductive state.

Upon removing the electronic tour key 11 from a tour station, "read" switch S1 will open the ground to transistors Q1 and Q2 extinguishing whichever light emitting diode CR1 or CR2 was energized. If a proper comparison was made and the green light emitting diode CR1 has been lighted, it will now be extinguished and the collector of transistor of Q2 will go from a low state when it was conducting to a high state being pulled up through CR1 and R12. This puts the transition from a logical 0 to a logical high into binary counter ML5 which performs as a clocking feature to advance the counter downward one count. Thus, the counter digital output number will become one less in terms of its binary coded content than it was at the previous comparison. This puts a different binary code into the exclusive OR network ML1 so that the same wall station from which the electronic tour key 11 was just removed will no longer provide an illuminated green light emitting diode CR1 if the electronic tour key 11 is reinserted into the same tour station. The next station in sequence on the tour must be utilized to give a new lighting of the green light emitting diode CR1. This sequence is repeated in total throughout the tour route so that a security guard must travel from tour station to tour station along the tour route in sequence to keep the light emitting diode CR1 lighting when the electronic tour key 11 is presented to each subsequent tour station 13. The lighting of CR1 and the above described production of an advance signal for the counter ML5 continues until the content of the binary counter ML5 has been reduced to zero. At that time a borrow or logical low bit is produced by the binary counter and connected through capacitors C1 to the RS flip-flop comprised of ML2, Sections C and D. This will cause the output of ML2, Section C, to assume a logical 1 condition thereby driving transistor Q3 into the conducting state and placing the collector of Q3 at ground potential. This ground signal is used in conjuction with active tour stations 13, which are hereinafter described, to cancel a pre-programmed transmission in a delinquency reporting tour information signal receiver and alarm transmitter 14, or to activate a transmission in a positive reporting tour information receiver and alarm transmitter 14 when used to report the location and time of electrical plug-in connection between a tour station 13 and an electronic tour key 11.

In the instance described above where the ground potential at the collector of transistor Q3 is used to cancel a preprogrammed transmission, the tour information signal receiver and alarm transmitter 14 provides a verify signal to the active tour station 13 which indicates that the preprogrammed transmission has been cancelled. The verify signal is processed and passed along to the electronic tour key 11 in a manner to be described, to the base of transistor Q4 causing it to conduct. As the electronic tour key 11 is removed from the wall station 13 "read" switch S1 assumes its normal position placing the emitter of transistor Q4 at ground, thereby providing a logical low at the input of ML2, Section D, for resetting the RS flip-flop. Thus the logical 1 is removed from the base of transistor Q3, thereby removing the cancel information from the collector of transistor Q3. In addition a logical 1 is presented at the output of NAND gate ML2, Section D, for providing a pulse through capacitor C2 which is connected as a load signal to binary counter ML5 to reload the tour length into the binary counter allowing the entire tour sequence to begin again.

Power for the electronic tour key 11 is derived in this embodiment from a 4½ volt alkaline or mercury battery contained within the case sections 16 and 17. The entire workings of the electronic tour key 11 may be complementary metal oxide semi-conductor circuitry which has extremely low power requirements. Therefore there is no need for an on-off switch in the electronic tour key 11. In normal use the battery B1 will last from two to three months. The indicating light emitting diodes CR1 and CR2 are switched in such a manner that they will draw current only when the electronic tour key 11 is connected to a tour station 13. The terminals of battery B1 are brought out through terminals in electrical connector 19 to allow verification of battery condition at any time.

Figure 8:
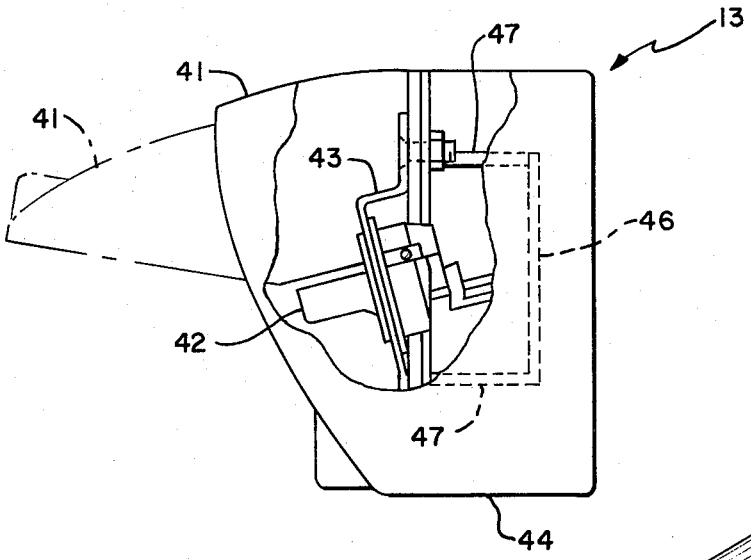
FIG. 8 is an elevation partial sectional view of a tour station.
Figure 9:
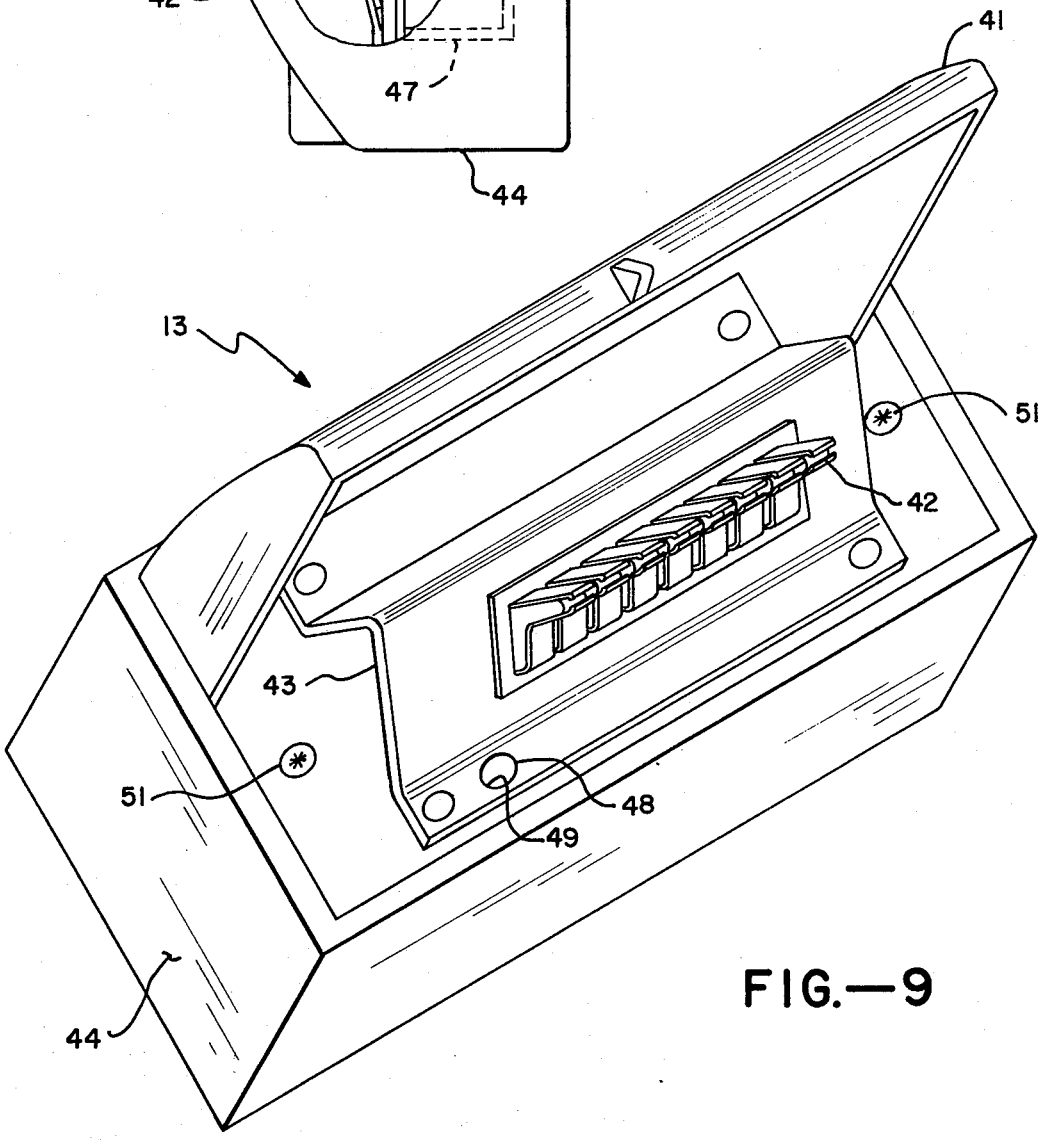
FIG. 9 is an isometric view of a tour station.

Referring to FIGS. 8 and 9 the following description holds true for the tour stations 13 both active and passive. Tour station 13 includes a rain-tight housing 41 in which is mounted an electrical connector 42 on a bracket 43 at a slight downward angle to facilitate mating with the electrical connector 19 on electronic tour key 11. In active tour stations 13 there is also mounted within an extension ring 44 attached to housing 41 an interface printed circuit card 46. Interface card 46 is mounted on a pair of stand-offs 47 attached to ring 44. Extension ring 44 allows mounting of the entire tour station assembly 13 onto a flat surface.

When interface printed circuit card 46 is used a small light emitting diode 48 is connected thereto for mounting behind a hole 49 in bracket 43. Light emitting diode 48 is visible from the front with the cover of housing 41 lifted and appears in a lighted condition during a predetermined time window provided by the tour information signal receiver and alarm transmitter 14 as hereinafter described. Housing 41 upon which bracket 43 is mounted is attached to extension ring 44 by means of two tamper-proof head screws 51.

Figure 10:
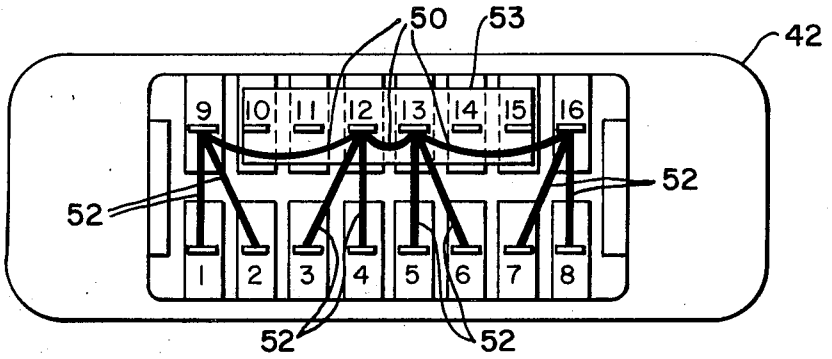
FIG. 10 is a rear elevational view of a connector in a tour station having fusible links attached.

Referring to FIG. 10 an assembly of the fusible lengths for setting tour station tour access and tour position codes is shown. Both passive and active tour stations 13 are so configured. FIG. 10 shows a blank or unprogrammed connector 42. Buss wire 50 is connected from pins 9 to 12 to 13 to 16 to provide a common side for the program bits. Eight fusible lengths 52 of electricaly conductive wire are connected between pins 9 and 1, 9 and 2, 12 and 3, 12 and 4, 13 and 5, 13 and 6, 16 and 7 and 16 and 8. The fusible lengths are of fuse wire or very fine wire that can be fused to an open or non-conductive condition under high current loads to provide the desired sequence of logical 1s and 0s for a four bit tour access code and a four bit tour position code. Pins 10, 11, 14 and 16 together with pins 12 and 13 are brought through connector 42 by use of a small multi-pin header 53 for connection with interface printed circuit card 46 in an active tour station 13. Buss wire 51*a* and fusible lengths of conductive wire 52 are potted in a substance to protect and support the fragile fusible wire 52, and thereafter connector 42 is set aside for later programming.

Figure 11:
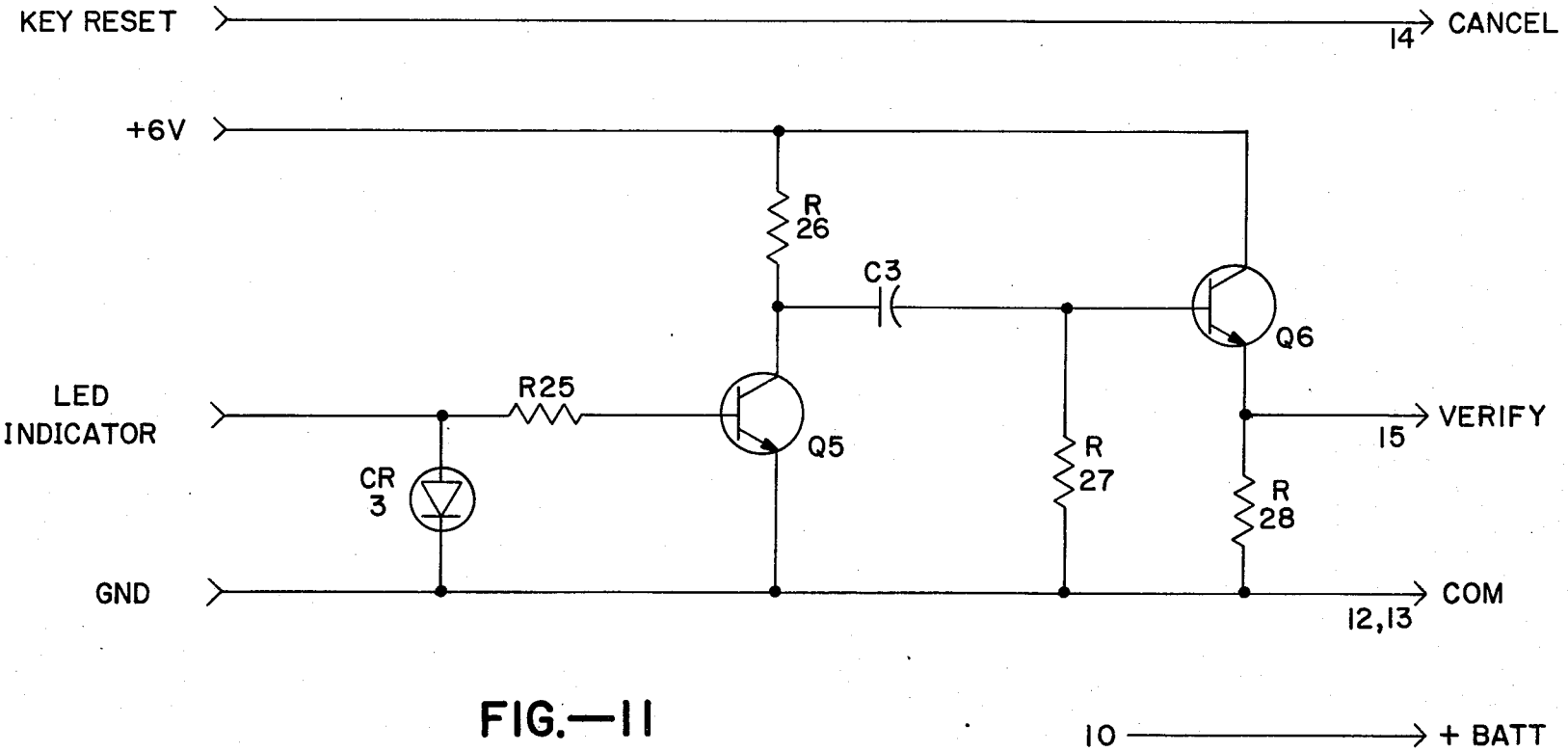
FIG. 11 is an electrical schematic diagram of the circuit in an active tour station.

Referring now to FIG. 11 the circuitry on interface printed circuit card 46 is discussed. In an active tour station 13 the cancel signal at the collector of transistor Q3 in FIG. 7 is passed through the tour station 13 in a line labeled key reset which is one of four lines going from interface card 46 to the tour information signal receiver and alarm transmitter 14. The actuating signal for light emitting diode CR3, which is item 48 in FIG. 9, also is derived from tour information signal receiver and alarm transmitter 14. Light emitting diode 48 is red in color in this embodiment, and when illuminated indicates that the predetermined time window is activated in the receiver and transmitter 14. Transistor Q5 is biased to a conducting condition whenever the light emitting diode 48 is energized, and is biased to a non-conducting state when it is not energized or dark. The collector of transistor Q5 is AC coupled through capacitor C3 and R27 to provide a momentary output at the emitter of transistor Q6 for the transition from light to dark of the light emitting diode 48. A short positive going pulse is generated at the emitter of Q6 when the light emitting diode 48 is extinguished. This voltage is presented across R28 as the verify signal mentioned above, which is connected to the electronic tour key 11 through the mating of connectors 42 and 19 to cause the electronic tour key 11 to reset and be ready for a new tour sequence starting with the first station in the tour as hereinbefore described.

Figure 12:
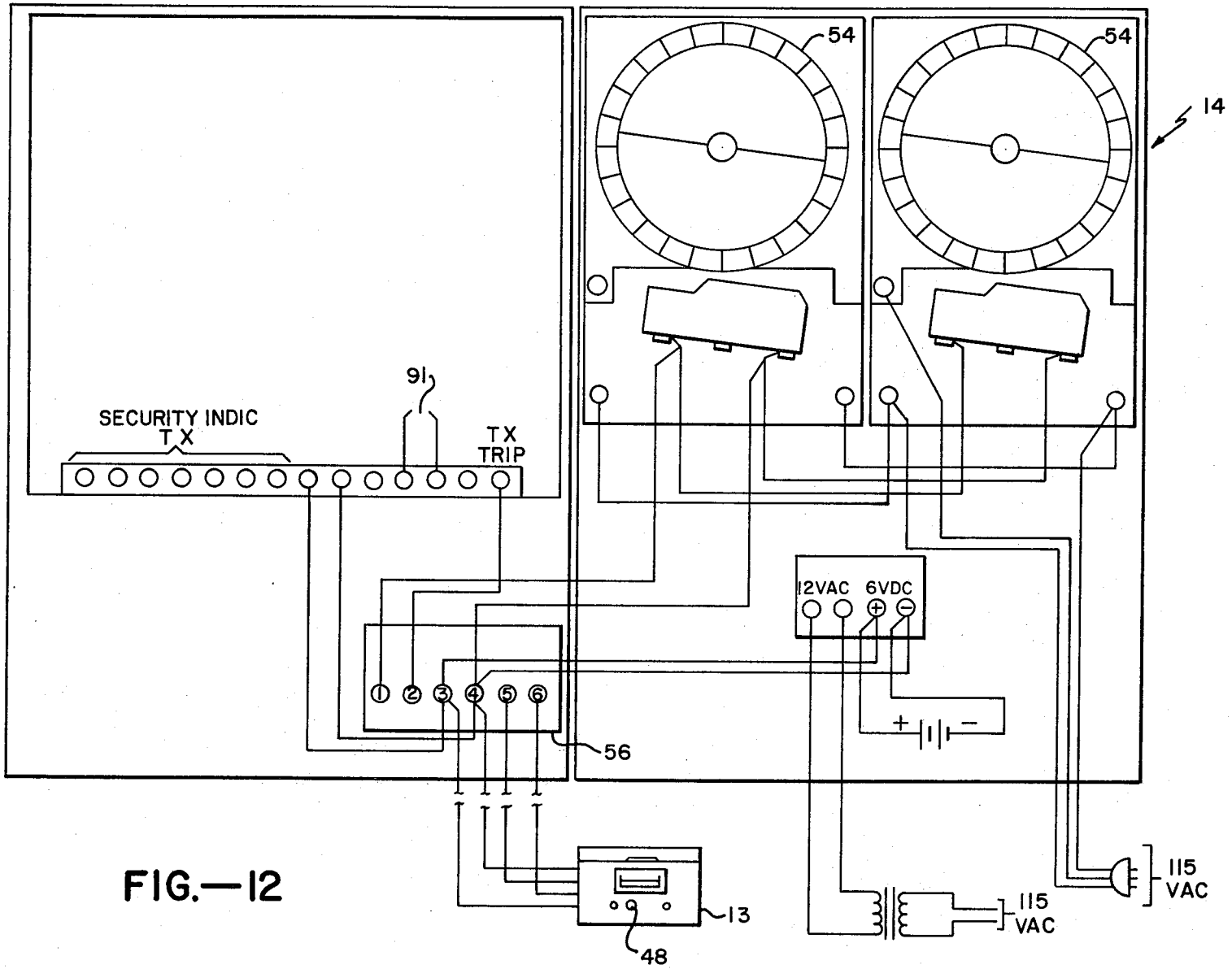
FIG. 12 is a mechanical and electrical schematic diagram of a tour information signal receiver and alarm transmitter.

Referring now to FIG. 12 a description of one embodiment of the tour information signal receiver and alarm transmitter 14 will now be undertaken. As seen in FIG. 12 the receiver and transmitter 14 is an exception or delinquency reporting transmitter for a remote security monitoring station. Receiver and transmitter 14 has contained a digital dialer and a transmitter for use over telephone lines and an input circuit which is activated by one or two 24-hour clocks. A single clock is all that is necessary when the security guard routine is identical through all seven days of the week. Two 24-hour clocks are necessary when a separate routine is maintained on different days of the week. For example, security routines may be of one configuration for a business week from Monday through Friday, and a separate routine may obtain for the weekend, Saturday and Sunday. A pair of timers or clocks 54 are programmed for check-in periods or predetermined time windows. These time windows may occur as often as every 30 minutes, but each time window covers 15 minutes in this embodiment. When the predetermined time window is activated then the light emitting diode 48 on an active tour station 13 will be illuminated and the transmitter 14 is armed to transmit to a remote security monitor station. If the light emitting diode 48 is turned off by actuation through the tour key system during the time window, then the transmitter 14 is disarmed. If the light emitting diode 48 in an active tour station 13 is illuminated for the full 15 minute time window and is turned off by the trailing edge of the time window, as hereinafter described, then the transmitter 14 will report the time and the location of the exception to the tour routine. This is done through normal subscriber indication and the time may be indicated at the remote security monitor station.

As seen in FIG. 12 the tour information signal receiver and transmitter includes timers 54. As shown therein the right hand timer 54 is used for the weekend routine and the left hand timer 54 is used for the routine followed during the days of the working week. These timers are interconnected in such a manner as to activate a timer interface printed circuit board 56. Timer interface board 56 contains circuitry which provides a security indication which activates a device for digitally dialing a telephone number after having seized a telephone line and for transmitting a coded message with parity check and handshake to a remote security monitoring station.

Figure 13:
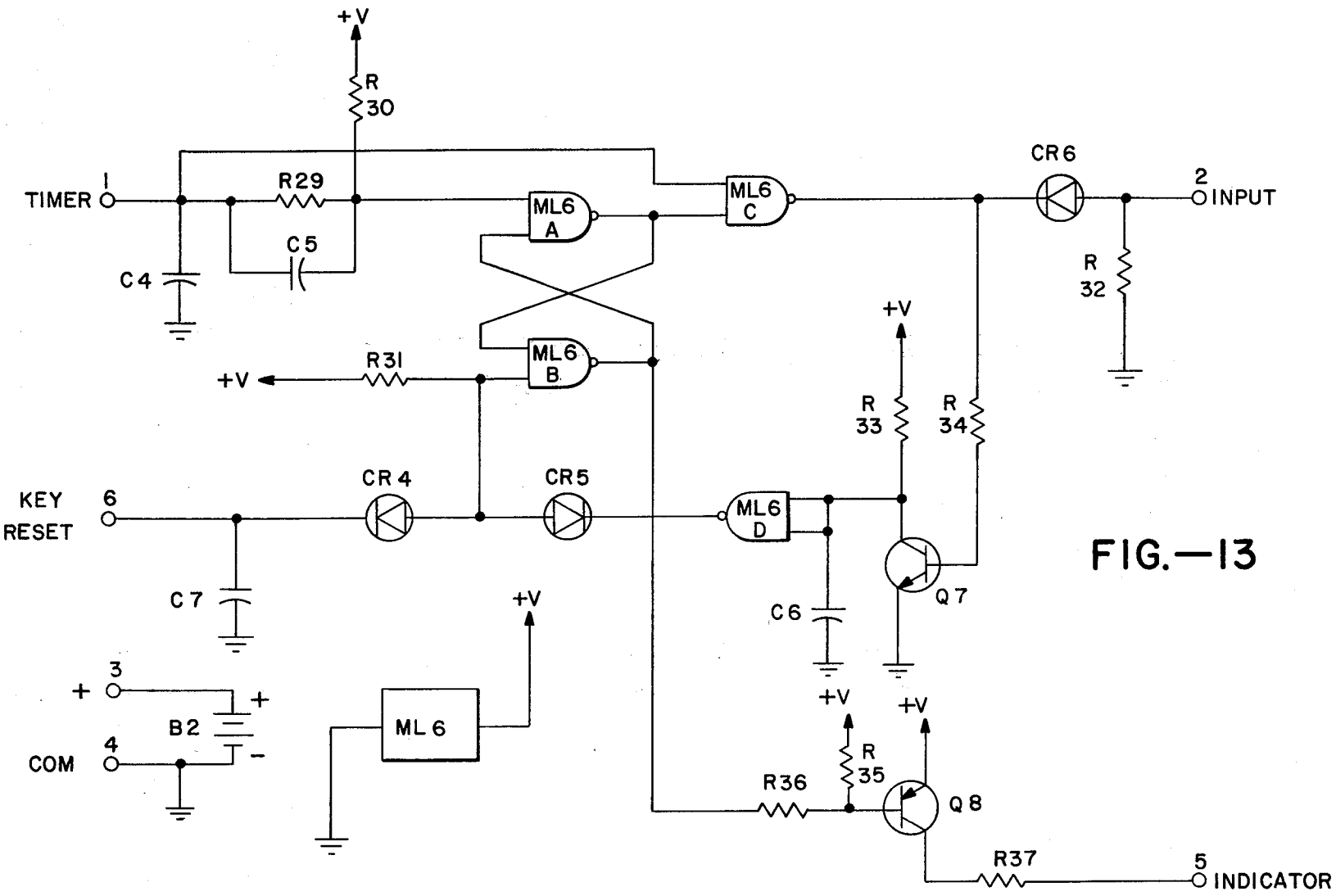
FIG. 13 is an electrical schematic diagram of a portion of the electrical circuit in the tour information signal receiver and alarm transmitter.

FIG. 13 is a detailed schematic of the circuit contained on timer interface printed circuit board 56. The input from timers 54 is connected to terminal 1 and sets the latch containing NAND gates ML6, Sections A and B. In this embodiment the input to terminal 1 is a logical 0 during the predetermined time window. When the latch is so set a logical 0 appears at the output of NAND gate ML6, Section B, driving the junction of resistors R35 and R36 to a logical 0 state compared to the supply voltage plus V. This causes transistor Q8 to conduct when connected through terminal 5 to the LED indicator terminal shown in FIG. 11. This illuminates the light emitting diode 48 in FIG. 11 during the predetermined time window. Also during the predetermined time window the output of NAND gate ML6, Section A, is at a logical 1 state. This 1 logic signal is placed at one of the inputs of NAND gate ML6, Section C, thereby enabling that gate. When the predetermined time window ends the input to terminal 1 in FIG. 13 rises to a logical 1 which is connected to NAND gate ML6, Section C. Enabled by the output of ML6, Section A, Section C thereby produces a logical low output. This is accomplished through a small delay imposed by the combination of R33 and capacitor C6 at the input of gate ML6, Section D, which delays latching until slightly after the time of the transition from low to high at the end of the predetermined time window. This provides an input to the transmitter, causing it to trip to seize a telephone line, dial the remote monitor station number and transmit the preprogrammed security indication message.

Figure 14:
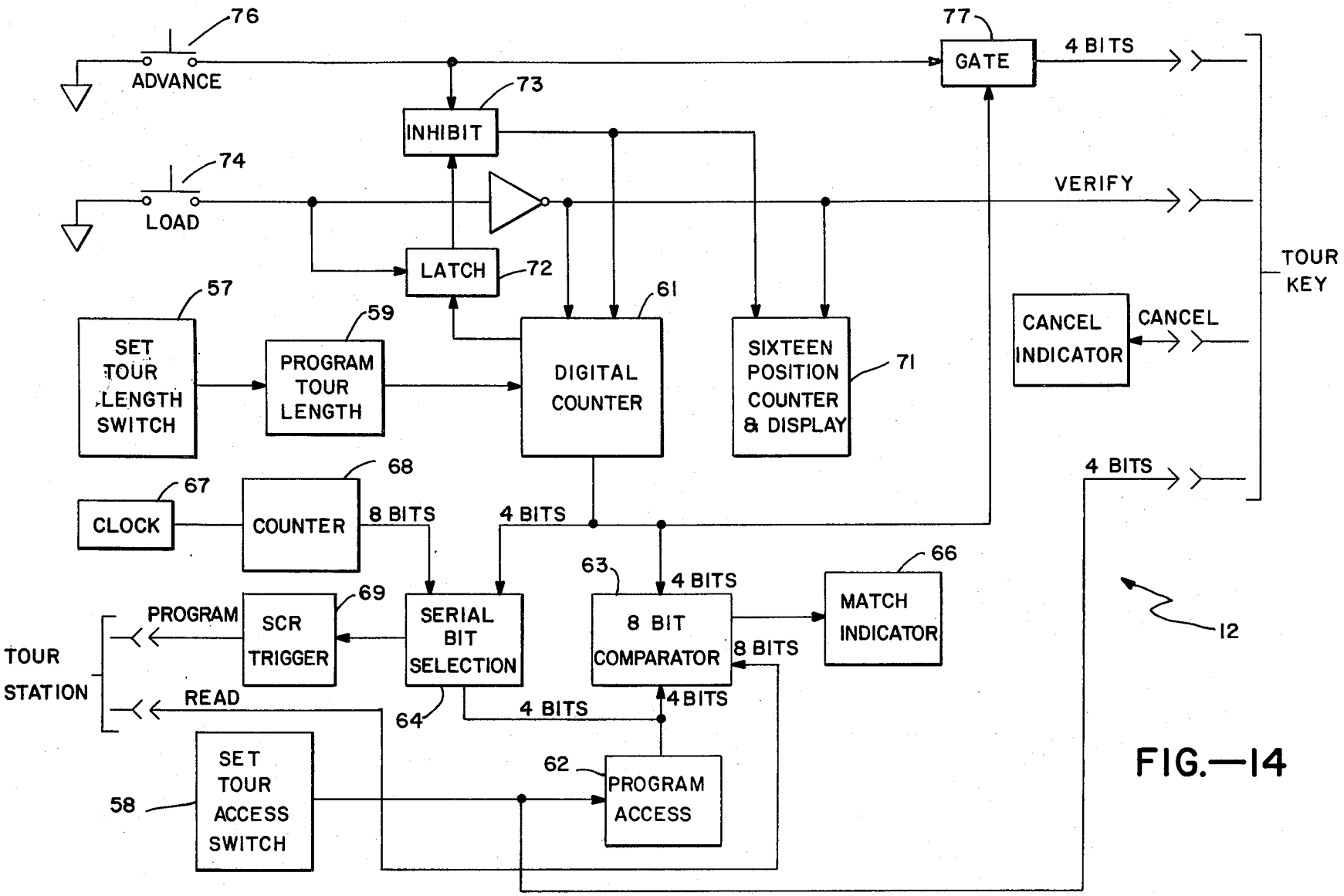
FIG. 14 is a block diagram of a programmer and verifier.

The tripping of the transmitter described immediately above, may be defeated by resetting the latch through the key reset terminal 6 which is connected to the circuit on interface printed circuit card 46 when the cancel signal from electronic tour key 11 as described above is passed therethrough as shown in FIG. 11. As stated before the cancel signal is a ground signal which provides a logical 0 through diode CR4 to one of the inputs of NAND gate ML6, Section B. This drives the output of section B to a logical 1 terminating conduction through Q8 and extinguishing light emitting diode 48 in tour station 13. It also sets a logical 0 at the output of NAND gate ML 6, Section A, for removing the enabling signal from ML6, thereby preventing transmitter tripping at the end of the predetermined time window. If a transmission has been allowed by tripping of the transmitter as described above, reset of the latch in FIG. 13 is accomplished by turning off transistor Q7 which is allowed to conduct during the time span of the predetermined time window. When Q7 is turned off after the transmission has been allowed, the inputs to NAND gate ML6, Section D, go from a logical 0 condition to a logical 1 condition providing a logical 0 at the output thereof. In this fashion a logical 0 is presented through CR5 to the input of ML6, Section B, and the same sequence occurs as was described for a logical low input thereto through key reset terminal 6. There is an appropriate delay after the trailing edge of the predetermined time window provided by the charge time of capacitor C6 through resistor R33. A DC supply B2 is provided in the receiver and transmitter 14 for providing the DC power required in the circuit of FIG. 13. A description of the programmer and verifier 12 for the electronic security tour system is made by reference to FIG. 14. The block diagram of FIG. 14 shows a tour length switch 57 and a tour access switch 58. The tour length switch 57 provides a tour length program 59 which is used to preload a binary counter 61. The tour access switch 58 sets an access program 62 which transmits digital bits to an eight bit digital comparator 63 and a serial bit selector 64. The output of digital counter 61 is also directed to eight bit digital comparator 63 and serial bit selector 64.

When the programmer and verifier 12 is used for reading the tour station address code, the code is connected directly to eight bit comparator 63. An output from the comparator 63 is provided to a match indicator 66 for indicating if there is a code match between the code set in the verifier 12 and the code in the tour station 13 under test. When the programmer and verifier 12 is used for programming the tour station address code in a tour station 13 the preset tour position code from digital counter 61 and the preset tour access code from tour access program 62 are connected to the serial bit selector 64. A clock 67 drives a counter 68 which presents a signal to serial bit selector 64 for serially selecting means for triggering 69 to direct high current levels through the fusible lengths 52 in tour station 13 for fusing predetermined ones of the lengths 52 to a non-conducting condition.

A 16 position counter and display 71 is provided which runs in synchronism with digital counter 61 for energizing labeled display lights to indicate the position in a tour being verified or programmed. A latch 72 is provided which is set by the end of the count from digital counter 61. Latch 72 provides means 73 for inhibiting digital counter 61 and sixteen position counter 71 after the count in digital counter 61 has been reduced to zero. A load push button 74 is provided for resetting latch 72 and for reloading the program tour length in digital counter 61. An advance switch 76 is provided which provides an advance pulse when actuated which is passed by the means for inhibiting 73, until set as described above by latch 72, for advancing both digital counter 61 and sixteen position counter 71 one step at a time. A gate 77 is provided for presenting the tour position code from digital counter 61 to a tour key 11 under test, which is gated off during depression of advance push button 76 for causing an advance in the output of digital counter 61. A cancel indicator is provided for receiving the cancel signal from the electronic tour key 11 and for providing visual indication thereof.

Figure 15A:
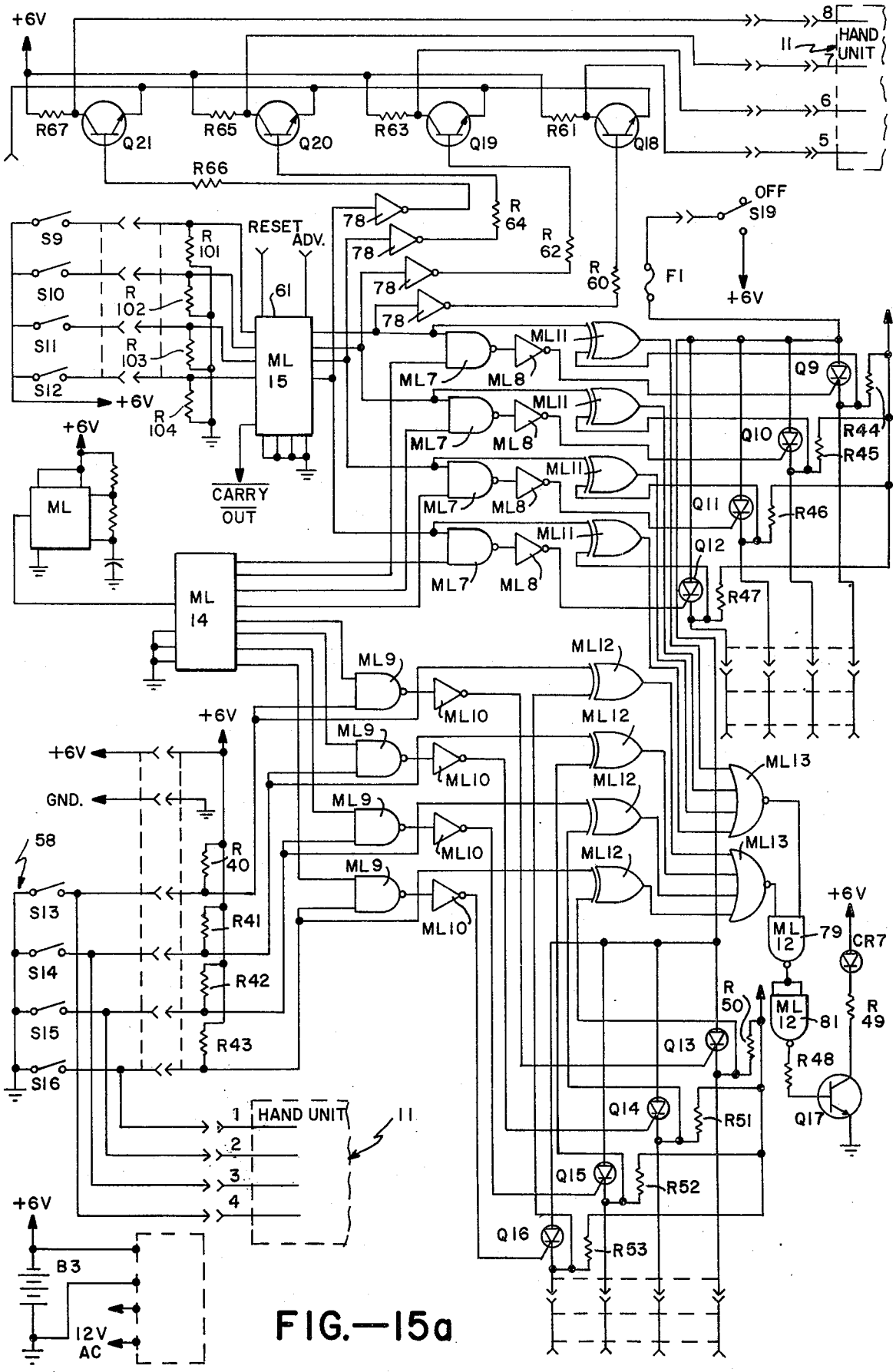
FIG. 15*a* is a partial electrical schematic diagram of the programmer and verifier of FIG. 14.
Figure 15B:
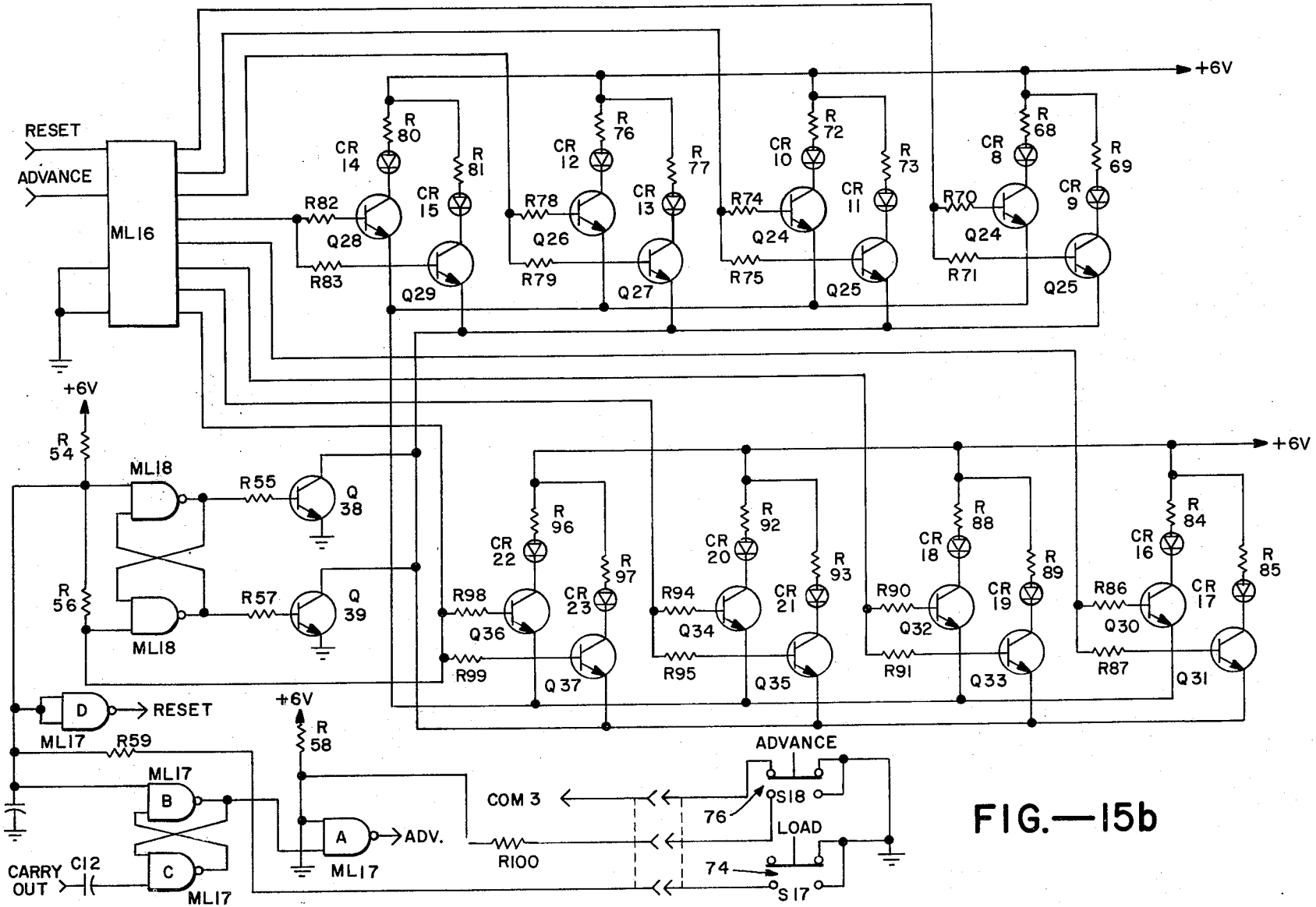
FIG. 15*b* is a partial electrical schematic diagram of the programmer and verifier of FIG. 14.

Referring to FIGS. 15*a* and 15*b* an electrical schematic of the programmer and verifier 12 is shown. The tour length select switches are shown at S9 through S12. The tour access select switches are shown at S13 through S16. Both the tour length and tour access select switches are provided in the present embodiment in the form of thumb-wheel switches on the front panel of the programmer and verifier 12. The tour length select switches S9 through S12 are used to preload a binary counter ML15 which appears as item 61 in FIG. 14. The various tour position indications or codes are provided by ML15 as it is stepped through the number of preselected tour positions by the advance switch. The tour access switches S13 through S16 provide a binary identifier that is processed by the electronic tour key 11, when being tested. This binary code set in the programmer and verifier 12 is compared to the content of the electronic tour key 11 for verification of the tour key tour access code, or is used to set the program in the tour station 13 when the programmer and verifier 12 is used for that purpose.

When used in the programming mode the gating provided by NAND gates ML7 and ML9 allow for the individual fusible lengths 52 in the tour stations 13 to be fused for opening the electrically conductive path therethrough one at a time so as to preclude the possibility of an overload current condition within the programmer 12. The timing for the selection of the fusing of the fusible lengths 52 is provided sequentially by ML14 which is a counterchip, which is driven at a relatively low frequency such as 0.5 hertz, by a free-running oscillator ML19. In this fashion counter ML14 serially provides an output in sequence at each of the NAND gates Ml7 and ML9. These outputs are connected to the triggers of silicon controlled rectifiers Q9 through Q16. When switch S19, which is spring loaded to the off position, is actuated to the plus voltage terminal, Q9 through Q16 conduct a high current level in sequence as selected by the output of ML15 and the tour access codes selected at switches S13 through S16. In this fashion the fusible lengths 52 are fused open with respect to ground for those bits which must show as a logical 1. The supply current path for fusing conductive lengths 52 is provided through fuse F1 and the lock switch S19. Switch S19 enables the operator to be sure he has the station to be programmed selected at the face of the programmer before sequential application of high current so that he will avoid encoding the improper code in a tour station 13 or making alterations in a previously properly encoded tour station 13. An eight bit digital comparator is seen as including four sections of exclusive OR gate ML11, four sections of exclusive OR gate ML12 and NOR gates ML13. When an electronic tour key 11 is plugged into the programmer and verifier 12 for verification of the tour access code and the tour length code the operation is as follows. A tour access code as set on the tour access switch 58 is connected to the electronic tour key 11 for comparison with the tour access code contained therein. The tour length code as set at the tour length switch 57 is presented to the electronic tour key 11 by way of counter ML15 inverters 78 and transistors Q18 through Q21. The manner in which the tour access and tour length codes are compared and processed in electronic tour key 11 has been described hereinbefore in connection with the description of the electronic tour key schematic in FIG. 7.

Verification of a tour station 13 by using the programmer and verifier 12 involves setting the predetermined tour access code at switches S13 through S16 and the predetermined tour position code at switches S9 through S12. Comparison of the tour access code contained in the tour station address code is made by connecting the tour station tour access code to the input of the exclusive OR gate ML12. The tour position code is brought into the programmer and verifier 12 and placed on the inputs of individual ones of the exclusive OR gate ML11 for comparison with the tour position output code from digital counter ML15. In the event all of the bit pairs match the exclusive OR gates provide logical 0 outputs to the inputs of the NOR gates ML13, which in turn produce logical 1 outputs to the input of NAND gate 79. NAND 79 provides a logical 0 output which is presented to both inputs of NAND gate 81 for providing a logical 1 at the base of transistor Q17. Q17 is thereby placed in a conducting condition, illuminating light emitting diodes CR7 for indicating a match between the codes being verified and the codes set in the programmer and verifier 12 by the tour length switch 57 and tour access switch 58.

ML16 is an octal counter and is used to drive a front panel indication of program position. This is accomplished through the transistors Q22 through Q37 and a like number of light emitting diodes CR8 through CR23. A flip-flop comprised of the two sections of NAND gate ML18 is used to select alternate sets of eight of the foregoing transistors Q22 through Q37, so that the counter display may show as high as 16 positions. The advance signal for counter ML16 as well as counter ML15 is obtained from a front panel push button S18 seen as item 76 in FIG. 14, which is labeled "advance". The advance signal is brought through a NAND gate ML17, Section A, which is enabled by the output of a latch comprised of Sections B and C of ML17. When the carry-out function from ML15 assumes a logical low condition, such as when it has counted down through the entire digital number loaded therein by tour length switch 57, or when a carry function is being performed, a logical 0 will be placed on the input of ML17, Section A, preventing further advance pulses from being gated therethrough. This is necessary to inhibit the programmer from stepping past the last station in a tour having a predetermined tour station length. Once the borrow signal from ML15 has latched ML17, Sections B and C, to inhibit advance pulses, latch may be reset by depressing load switch S17 thereby placing a logical 0 at the input to ML17, Sections B and D. ML17, Section A, is thereby enabled again and is prepared to pass further advance pulses upon depressing advance switch S18.

Another function of the load switch S17 is to generate a reset pulse through NAND gate ML17, Section D. The reset pulse is connected to reset the latch used to select the two groups of eight display drivers for the sixteen light emitting diode array which indicates position in the tour length code. The reset pulse is also used to reset octal counter ML16 and to reload the tour length code selected at tour length switch 57 into counter ML15.

The manner in which the electronic tour key 11 is verified relating to the internal function of the tour key was described above. The detailed function of the transistors Q18 through Q21 will now be described. These four transistors provide tour position information to the electronic tour key 11 because of the interconnection of COM 3 and the advance switch. The tour position information is presented to the electronic tour key 11 whenever the advance switch S18 is in its normal condition. In operation, this provides the electronic tour key 11 with station information and, if in agreement with the tour position code of the tour key, will cause the green light emitting diode 29 to be illuminated whenever the advance switch S18 is in its normal position. The red light emitting diode 29 on the tour key 11 will be illuminated whenever the advance switch is depressed, COM 3 being lifted from ground at the advance switch S18 so that the electronic tour key 11 is not presented any true bits.

Figure 16:
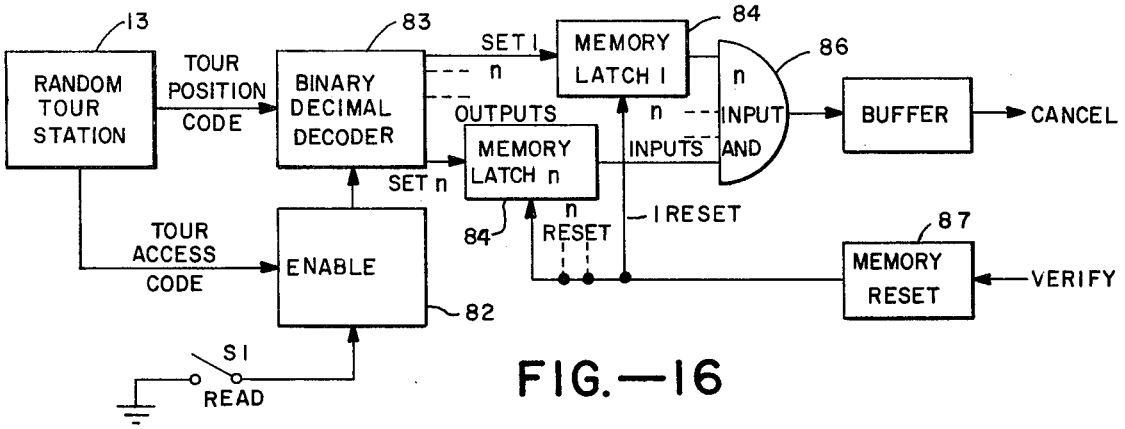
FIG. 16 is a block diagram of a random sequence electronic tour key.

Reference is now made to FIG. 16 in which appears a block diagram of a random sequence electronic tour key. A random tour station 13 is configured as described above providing a tour position code and a tour access code. When the random sequence electronic tour key makes a plug-in electrical connection with a tour station 13, the tour access code from the tour station is connected to an enable circuit 82. "Read" switch S1 is also connected to enable circuit 82. Enable circuit 82 is connected to a binary decimal decoder 83 for producing an output at one of a plurality of output terminals determined by the tour position code from tour station 13. A plurality of n memory latches 84 are connected to individual ones of the output of binary decimal decoder 83. A summing gate 86 receives the outputs of memory latches 84 for producing an output when a predetermined number of different tour stations 13 have received plug-in electrical connections with the random sequence tour key. A tour information signal such as the cancel signal seen in FIGS. 7 and 11 is produced by summing gate 86. A memory reset 87 is present to provide reset signals for memory latches 84 after a random sequence tour has been completed.

Figure 17A:
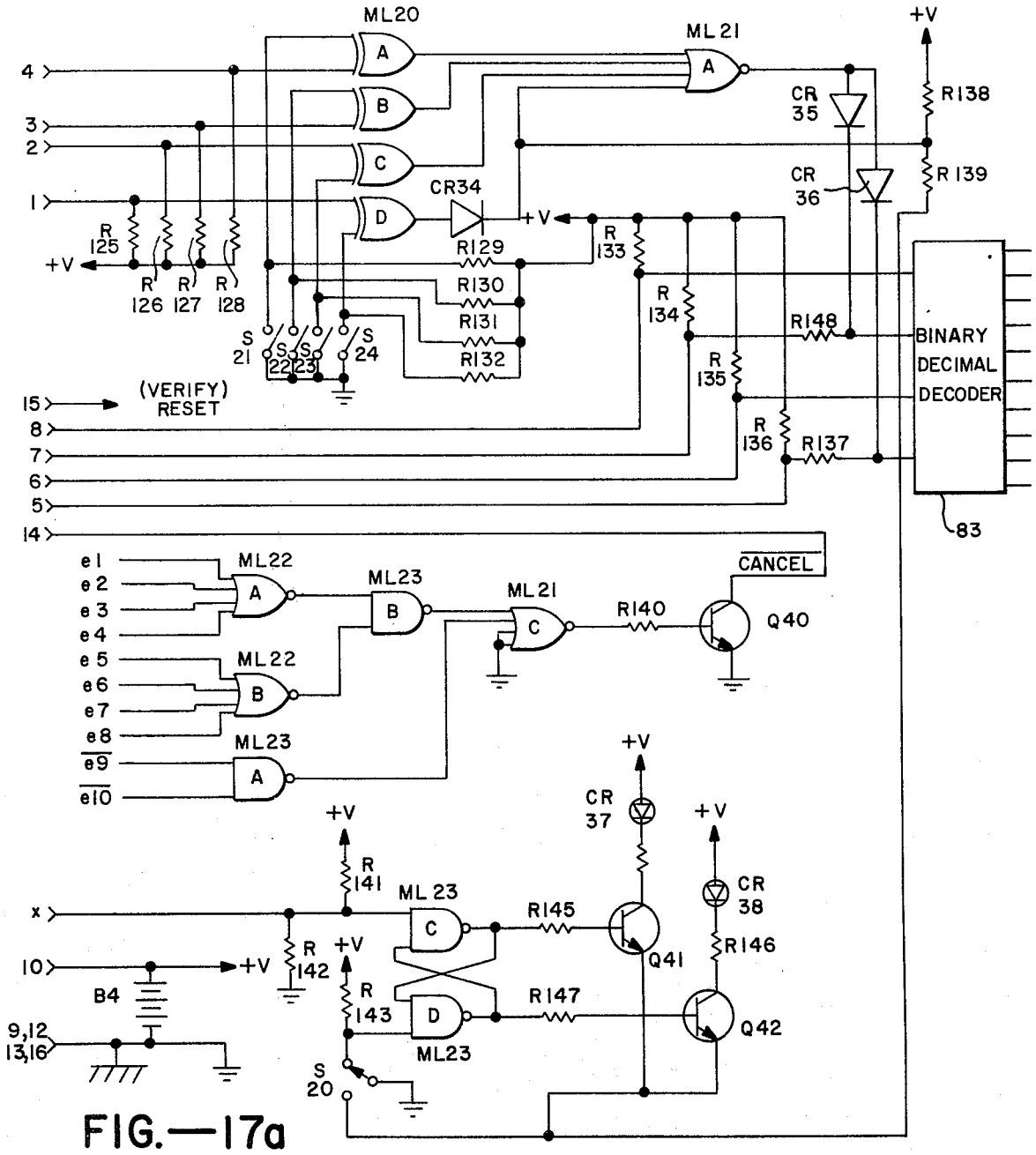
FIG. 17*a* is an electrical schematic diagram a portion of of the random sequence electronic tour key of FIG. 16.
Figure 17B:
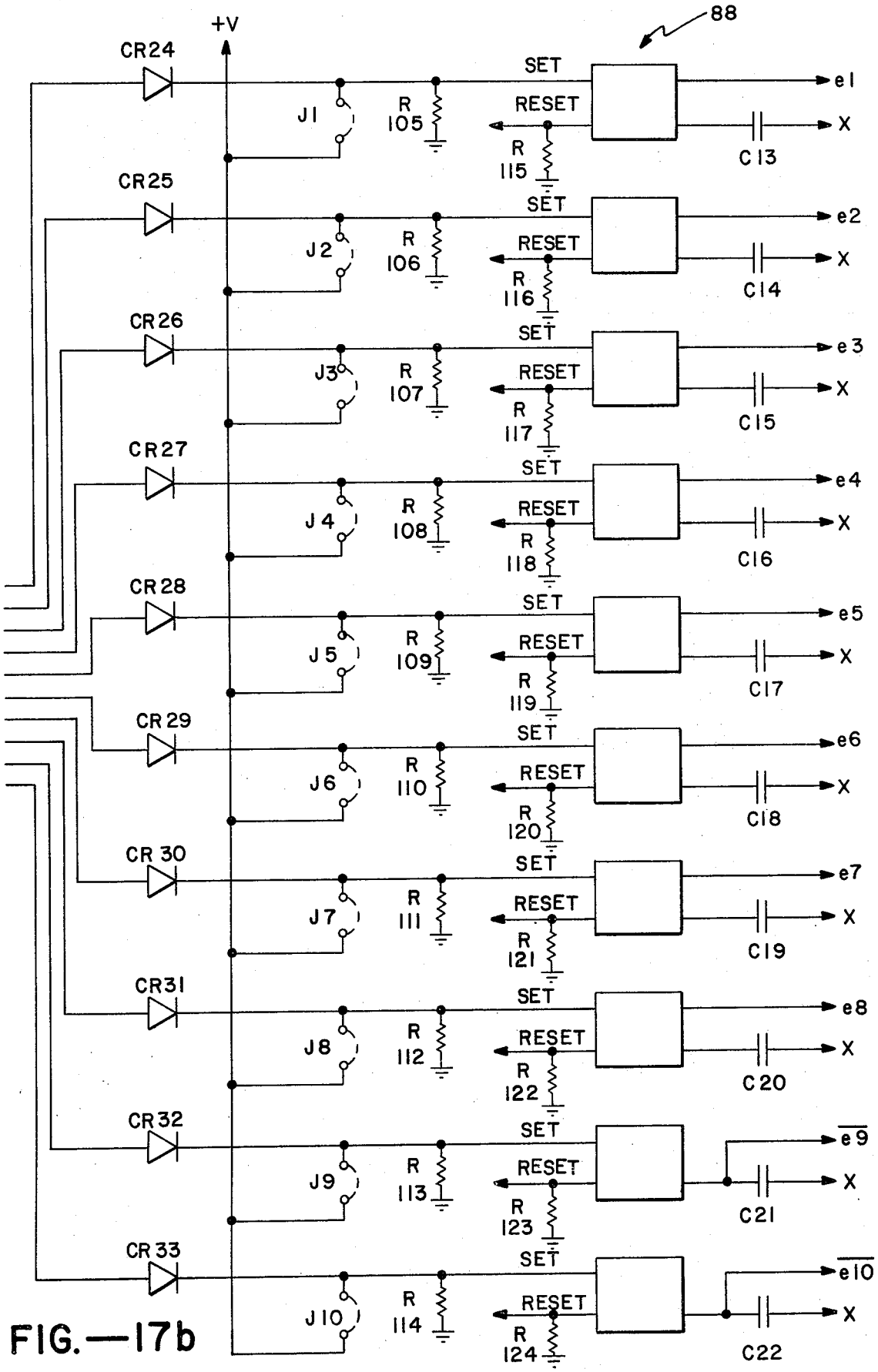
FIG. 17*b* is an electrical schematic diagram of a further portion of the random sequence electronic tour key of FIG. 16.

Turning now to FIG. 17 a schematic of one embodiment of the random sequence electronic tour key is depicted. The same tour station 13 is used with the random sequence tour key as with the predetermined sequence tour key 11. A tour access code is brought into the random tour key at terminals 1 through 4 for comparison with a tour access code set therein by positioning switches S21 through S24. As described above the tour access code is programmed by closing ones of switches S21 through S24 for providing a logical 0, and opening them for providing a logical 1. The bit pairs are directed to exclusive OR gates ML20, Sections A through D, where, if they are similar, logical low outputs are produced. It should be noted here that plug-in electrical connection between a random tour key and a tour station 13 causes switch S20 to place a ground potential at one end of resistor R139 thereby providing a logical 0 at the junction between R139 and R138. In this fashion NOR gate ML21, Section A, is enabled to receive logical 0s at all four inputs if the tour access bit pairs are similar. NOR gate ML21, Section A, therefore provides a logical 1 output when the random tour key is used at tour stations 13 on the proper tour route.

The tour position code from the tour station 13 is brought in on pins 5 through 8 of the random tour key for presentation at the input side of binary to decimal decoder 83. Dependent upon the binary code presented thereto, the binary to decimal decoder 83 will provide an output logical 1 at one of the 10 output lines therefrom. The output logical 1 will set one of a plurality of latches 88 which will provide a logical 0 at the output of the set latch 88. As the latches 88 are set the outputs $e_1$ through $e_8$ are connected to NOR gates ML22, Sections A and B. The complementary outputs $\bar{e}_9$ and $\bar{e}_{10}$ are set at a logical 1 level when the latches are set. $\overline{E}_9$ and $\bar{e}_{10}$ are directed to the NAND gate ML23, Section A. If there are 10 tour stations 13 on the tour route all of the outputs $e_1$ through $\bar{e}_{10}$ are presented to the inputs of ML 22, Sections A and B, and ML23, Section A. The outputs of ML22, Sections A and B, are logical 1s and are presented to the inputs of NAND gate ML23, Section B, for producing a logical 0 connected to ML21, Section B. The A section of ML 23 produces a logical 0 also presented to the input of ML21 Section B. All inputs to ML21, Section B, being logical 0s the output therefrom is a logical 1 which causes Q40 to conduct placing the collector thereof at ground potential. A cancel or tour information signal is thereby presented at pin 14 which is utilized as described hereinabove.

In the event any of the 10 latches 88 are not to be used the appropriate jumper J1 through J10 is placed to connect a logical 1 to the set input of the latch. This permanently latches the e output at a logical 0 and permanently latches the e output at a logical 1. In this fashion a tour route may be serviced having fewer than 10 tour stations 13 while using the embodiment of FIG. 17.

The outputs from the latches 88 marked X are brought into the latch comprised of NAND gates ML23, Sections C and D. At initial conditions the input to ML23, Section C, is a logical 1. When the tour key is inserted into a tour station 13 and S20 is actuated to place Q41 and Q42 emitters at ground, the input to ML23, Section D, transits from a logical 0 to a logical 1. As soon as a latch 88 is set a logical 1 output appears at the capacitor in the X output line. This causes a transient logical 0 to be connected to the input of ML23, Section C. Since a NAND gate with a 0 at one input forces a logical 1 output the transistor Q41 is biased to a conducting condition lighting CR37 which is a green light emitting diode and indicating a proper memory register of one of the tour station codes. At the same time the input to ML23, Section D, having two logical 1 inputs provides a logical 0 output placing Q42 in a non-conducting state. When the X input to ML23, Section C, returns to a logical 1 the inputs there are a logical 1 and a logical 0 for latching Q41 in a conducting condition.

When the random electronic tour key is withdrawn from plug-in electrical connection with the tour station 13, switch S20 returns to its normal condition lifting the collectors of Q41 and 42 from ground and providing a reset for the latch at the input of ML23, Section D. If the random electronic tour key is reinserted in the same tour station 13 there will be no temporary logical 0 at the X input to the latch since the particular latch 88 is already in a set position. Therefore the latch comprised of ML23, Sections C and D, would remain in the reset condition with a logical 0 at the output of Section C and logical 1 at the output of Section D. The emitters of Q41 and 42 being replaced to ground by the action of insertion of the random electronic tour key into the same tour station 13, transistor Q42 would be biased to a conducting condition thereby lighting the red light emitting diode CR38 and indicating to the security guard that this particular tour station 13 has already been recorded in the random electronic tour key memory. Terminal pin 15 is provided to receive a verify or reset signal which is a logical 1. Latches 88 are therefore reset after a random tour has been completed and the memory latches 88 are thereafter in condition for storing a memory of plug-in electrical connection at each of the tour stations 13 on the random tour route.

An additional feature of the tour information signal receiver and alarm transmitter 14 is that the guard may initiate an emergency or panic transmission to the remote security monitor station, said transmission message being discrete from any tour information message, by operation of a lock-in emergency switch (not shown). A plurality of said emergency switches may be connected in parallel to provide convenient placement of said switches along the tour. Said switches connect to terminals 91 as seen in FIG. 12.

An electronic security tour system has been disclosed utilizing a plurality of tour stations positioned along a tour route and utilizing either a sequential electronic tour key or a random electronic tour key. The tour system also includes a programmer and verifier for setting tour station address codes and for verifying tour station address codes and key address codes. The tour system also includes a tour information signal receiver and alarm transmitter for providing a security indication to a remote security monitor station.

We claim:

1. A security monitoring system of the type wherein a predetermined tour route is established for excursion by a guard and which provides a signal for connection to a remote security monitor station, comprising an electronic tour key for carrying by the guard, means for programming a plurality of key address codes in said electronic tour key, means for programming a key tour access code in said electronic tour key, a plurality of tour stations spaced along the predetermined tour route, means on each of said tour stations for plug-in electrical connection with said electronic tour key, means for programming a station tour access code in each of said plurality of tour stations, said station tour access being common to each of said tour stations defining the predetermined tour route, means for programming a predetermined station address code in each of said tour stations, said electronic tour key providing a tour information signal when plug-in electrical connection is made with a predetermined number of tour stations having station address codes matching ones of said key address codes, and having a station tour access code matching said key tour access code, means for receiving said tour information signal within a predetermined time window and for providing a security indication dependent upon receipt of said tour information signal, at least one of said plurality of tour stations being located for plug-in electrical connection at said predetermined number sequence on the tour route and having means for connecting said tour information signal to said means for receiving, so that said security indication is presented to the remote security monitor station.

2. A security monitoring system of the type wherein a predetermined tour route is established for excursion by a guard and which may be connected to a remote security monitor station, comprising an electronic tour key for carrying by the guard, means for programming a plurality of key address codes in said electronic tour key, a plurality of tour stations spaced along the tour route, means on each of said tour stations for plug-in electrical connection with said electronic tour key, means for programming a predetermined station address code in each of said tour stations including means for setting a tour access code which is the same in each tour stations on the tour route, and means for setting a tour station code which is sequential among said tour stations on the tour route, said electronic tour key providing a tour information signal when plug-in electrical connection is made with a predetermined number of tour stations having station address codes matching ones of said key address codes, means for receiving said tour information signal within a predetermined time window and for providing a security indication dependent upon receipt of said tour information signal, at least one of said plurality of tour stations being located for plug-in electrical connection at said predetermined number sequence on the tour route and having means for connecting said tour information signal to said means for receiving, so that said security indication is presented to the remote security monitor station, said means for programming a plurality of key address codes including means for setting said tour access code, and means for setting a sequential tour length code having as many sequential codes as there are tour stations on the tour route, and means for advancing in sequence through said tour length code responsive to said matching between ones of said key address codes and said predetermined station address code, whereby a predetermined sequence of plug-in electrical connections among said predetermined number of tour stations must be performed by the guard before said tour information signal is provided.

3. A security monitoring system as in claim 2 together with switch means connected to the last in the sequence of said tour stations for resetting said sequential tour length code.

4. A security monitoring system as in claim 3 together with additional switch means connected to intermediate ones of said plurality of tour stations, whereby said sequential tour length code is reset more than once on the tour route, thereby increasing the number of tour stations in said plurality of tour stations.

5. A security monitoring system of the type wherein a predetermined tour route is established for excursion by a guard and which may be connected to a remote security monitor station, comprising an of plug-in electrical connection with each tour station on the tour route, whereby a random sequence of plug-in connections may be performed by the guard before said tour information signal is provided.

6. A security monitoring system as in claim 5 wherein said memory means has a fill capacity determined by the number of said tour stations on the tour route, together with switch means actuated by said memory means when said fill capacity is reached, said switch means operating to provide said tour information signal.

7. A security monitoring system as in claim 6 wherein said means for receiving produces a reset output in response to said tour information signal, said reset output being connected to a designated last tour station on the tour route, and means for transmitting said reset output to said electronic tour key for resetting said memory means fill capacity to zero.

8. A security monitoring system as in claim 1 wherein said means for receiving said tour information signal includes means for producing a delinquency signal at the end of said predetermined time window when said tour information signal is not received before the trailing edge thereof, and means for transmitting said delinquency signal to the remote monitoring station, whereby said security indication is presented to the remote monitoring station when the tour route excursion time is greater than said time window.

9. A security monitoring system as in claim 1 wherein said means for receiving said tour information signal includes means for producing a signal for transmission to the remote monitoring station upon receipt of said tour information signal, whereby said security indication is directly reported.

10. A security monitoring system as in claim 9 wherein said predetermined number of said tour stations is less than said plurality of tour stations, and wherein said means for receiving said tour information includes means for transmitting said signal for transmitting to the remote monitoring station, whereby more than one of said security indications is directly reported during each excursion of the tour route.

11. A security monitoring system of the type wherein a predetermined tour route is established for excursion by a guard and which may be connected to a remote security monitor station, comprising an electronic tour key for carrying by the guard, means for programming a plurality of key address codes in said electronic tour key, a plurality of tour stations spaced along the tour route, means on each of said tour stations for plug-in electrical connection with said electronic tour key, means for programming a predetermined station address code in each of said tour stations, said electronic tour key providing a tour information signal when plug-in electrical connection is made with a predetermined number of tour stations having station address codes matching ones of said key address codes, means for receiving said tour information signal within a predetermined time window and for providing a security indication dependent upon receipt of said tour information signal, at least one of said plurality of tour stations being located for plug-in electrical connection at said predetermined number sequence on the tour route and having means for connecting said tour information signal to said means for receiving, so that said security indication is presented to the remote security monitor station, a programmer, a plurality of electrical terminals on said means for plug-in electrical connection, means carried by said programer for electrical connection to each of said plurality of electrical terminals, said means for programming a predetermined station address code in each of said tour stations comprising electrically conductive fusible links connected between predetermined ones of said plurality of electrical terminals, and means for providing an electric current to said means for electrical connection according to a predetermined digital number so that preselected ones of said fusible links are connected to said electric current to be fused thereby interrupting a conductive path therethrough, and so that other preselected ones of said fusible links are isolated from said electric current to remain conductive.

12. A security monitoring system as in claim 11 together with means for sequentially providing said electrical current to said preselected ones of said fusible links, whereby instantaneous current levels may be limited to that required to fuse one of said fusible links at a time.

13. A security monitoring system of the type wherein a predetermined tour route is established for excursion by a guard and which may be connected to a remote security monitor station, comprising an electronic tour key carrying by the guard, means for programming a plurality of key address codes in said electronic tour key, said plurality of key address codes having a tour access and a tour length code, a plurality of tour stations spaced along the tour route, means on each of said tour stations for plug-in electrical connection with said electronic tour key, means for programming a predetermined station address code in each of said tour stations, said electronic tour key providing a tour information signal when plug-in electrical connection is made with a predetermined number of tour stations having station address codes matching ones of said key address codes, means for receiving said tour information signal within a predetermined time window and for providing a security indication dependent upon receipt of said tour information signal, at least one of said plurality of tour stations being located for plug-in electrical connection at said predetermined number sequence on the tour route and having means for connecting said tour information signal to said means for receiving, so that said security indication is presented to the remote security monitor station, a programmer for verifying the key address codes in said electronic tour key, said programmer including means for electrically connecting said tour key and said programmer, first switch means providing a first digital output for setting said tour access code in said programmer, second switch means providing a second digital output for setting said tour length code in said programmer, a digital counter connected to receive said second digital output for loading thereby and providing a third digital output, a digital comparator for receiving said first and third digital outputs and said tour access and tour length codes, and a matching indicator for indicating the match between the tour key code and said first and second switch means code settings.

14. A security monitoring system as in claim 13 together with means in said programmer for producing an advance signal for advancing said digital counter serially through said tour length, and means in said programmer for producing a reset signal for resetting said digital counter to the beginning of said tour length code.

15. A security monitoring system as in claim 14 together with means in said programmer for inhibiting said means for advancing when said last named means has advanced said digital counter through said entire tour length code.

16. A security monitoring system as in claim 14 together with a code position display in said programmer for indicating the position in said tour length to which said digital counter has been advanced.

17. A security monitoring system as in claim 13 together with a tour information signal indicator in said programmer for receiving said tour information signal from said electronic tour key and for indicating the end of said tour length code.

18. A security monitoring system of the type wherein a predetermined tour route is established for excursion by a guard and which may be connected to a remote security monitor station, comprising an electronic tour key for carrying by the guard, means for programming a plurality of key address codes in said electronic tour key including first switch means for providing a digital tour access code, second switch means for providing a digital tour length code, means for programming a plurality of key address codes in said electronic tour key, a plurality of tour stations spaced along the tour route, means on each of said tour stations for plug-in electrical connection with said electronic tour key, means for programming a predetermined station address code in each of said tour stations, said electronic tour key providing a tour information signal when plug-in electrical connection is made with a predetermined number of tour stations having station address codes matching ones of said key address codes, means for receiving said tour information signal within a predetermined time window and for providing a security indication dependent upon receipt of said tour information signal, at least one of said plurality of tour stations being located for plug-in electrical connection at said predetermined number sequence on the tour route and having means for connecting said tour information signal to said means for receiving, so that said security indication is presented to the remote security monitor station, said electronic tour key further including a digital counter for receiving said digital tour length code and providing a digital output, a digital comparator for receiving said digital output and said digital tour access code, said digital comparator also being connected to receive said station address code when plug-in electrical connection is made with one of said plurality of tour stations, a code match indicator connected to the output of said digital comparator, means connected between said code match indicator and said digital counter for advancing said counter after withdrawal of said electronic tour key from plug-in electrical connection with said tour station, and means for reloading said digital tour length code into said digital counter after withdrawal from the last of said tour stations on the tour route.

19. A programmer for use with apparatus in a security monitoring system of the type wherein a predetermined tour route has spaced therealong a plurality of tour stations having a tour station address code programmed therein for excursion by a guard carrying an electronic tour key having a plurality of key address codes programmed therein for electrical plug-in connection with each of the plurality of tour stations, comprising means for plug-in connection with the tour stations and the electronic tour key, first switch means for setting a programmer tour access code, second switch means for setting a programmer tour length code, a digital counter for receiving said programmer tour length code and producing a digital output, a digital comparator for receiving said digital output and said programmer tour access code, and means for indicating match between said programmer tour access and tour length codes and the tour station address code when said means for plug-in electrical connection is mated with a tour station, and for indicating match between said programmer tour access and tour length codes and the plurality of key address codes when said means for plug-in electrical connection is mated with the electronic tour key.

20. A programmer as in claim 19 together with a load switch for entering said tour length code into said digital counter, an advance switch for advancing said digital counter sequentially through said tour length code, and a tour key position indicator connected to said load switch and said advance switch for indicating the position in said tour length code to which said programmer has been advanced, so that said means for indicating match may provide a match indication for indicated key and tour station address codes.

21. A programmer as in claim 20 wherein said electronic tour key provides a tour information signal after a predetermined number of tour station plug-in connections, together with means for receiving said tour information signal and providing indication of receipt.

22. A programmer for use with apparatus in a security monitoring system of the type wherein a predetermined tour route has spaced therealong a plurality of tour stations having fusible conductive links contained therein connected between predetermined ones of a plurality of externally accessible electrical terminals, comprising means for electrical connection with the electrical terminals, first switch means for selecting a predetermined tour position code, a digital counter for receiving said tour position code, second switch means for setting a tour access code, a serial bit selector for receiving said digital output and said tour access code, means for passing current levels sufficient to fuse preselected ones of the fusible links actuated by said serial bit selector as determined by said digital output and tour access code, and means for programming said serial bit selector through said digital output digits and said tour access code digits sequentially, whereby the preselected ones of said fusible links are fushed one at a time reducing instantaneous current level requirements.

23. An electronic tour key for carrying by a guard for use with a security monitoring system of the type wherein a predetermined tour route has spaced therealong a plurality of tour stations for plug-in electrical connection by the guard in a predetermined sequence, and wherein the tour stations have a predetermined tour station address code programmed therein including a tour position code and a tour access code, comprising means for setting a tour length code, a digital counter for receiving said tour length code and providing a digital output, means for setting a tour access code, an electrical connector for mating with the tour stations, a digital comparator for receiving said digital output and said tour access code together with the tour position code and tour access code from the tour station, said digital comparator providing an output determined by the match between the tour position code and the digital output and between the tour access codes, a match indicator for receiving the output from said digital comparator, said match indicator providing an advanced signal to said digital counter upon withdrawing said electrical connector from the tour station so that said tour key must be electrically connected to the next tour station in the predetermined sequence before said digital counter will be advanced.

24. An electrical tour key as in claim 23 together with a latch for receiving a borrow signal from said digital counter when said digital counter has been advanced sequentially through said entire digital number, said latch producing a tour information signal thereafter, said electrical connector means having a terminal for receiving a reset signal subsequent to said tour information signal for resetting said latch, and means for connecting said latch to said digital counter for resetting said tour length code therein.

25. An electronic tour key for carrying by a guard for use with a security monitoring system of the type wherein a predetermined tour route has spaced therealong a plurality of tour stations for plug-in electrical connection by the guard, and wherein the tour stations have a predetermined station address code programmed therein including a tour position code and a tour access code, comprising a binary to decimal decoder for receiving the tour position code, means for setting a tour access code, means for enabling said binary to decimal decoder actuated by the tour access code, memory means for recording the tour position code when electrical plug-in connection is made with one of the plurality of tour stations when the tour access codes match and providing a plurality of memory outputs, each one of said plurality of memory outputs being related to one of the tour position codes, means for receiving the outputs of said memory means for providing a tour information signal after electrical plug-in connection with a predetermined number of tour stations having matching tour access codes, whereby the tour stations may be visited by the guard for plug-in electrical connection therewith in a random sequence for providing the tour information signal.

26. An electronic tour key as in claim 25 together with a latch for receiving the outputs of said memory means for setting said latch, and indicating means connected to said latch for providing visual indication of recording a tour position in said memory means, and for providing visual indication of when plug-in electrical connection is made at a tour station which has already been recorded in said memory means.

27. An electronic tour key for carrying by a guard for use with a security monitoring system of the type wherein a predetermined tour route is defined by a plurality of tour stations spaced therealong for plug-in electrical connection with the tour key and wherein the plurality of tour stations each have a predetermined tour station position code programmed therein, comprising an electrical connector for mating with the tour stations, means for setting a tour length code connected to said electrical connector, a digital counter for receiving said tour length code and providing a digital output, a digital comparator for receiving said digital output together with the tour station position code from the tour station, said digital comparator providing a comparator output determined by the match between the tour station position code and the digital output, said comparator output being coupled to enable said digital counter upon disconnecting said electrical connector from each one of said plurality of tour stations, to advance said digital counter upon connecting said electrical connector to the subsequent tour station, and to provide a tour information signal when plug-in connection has been made with each of a number of the tour stations corresponding to said tour length code.

28. An electronic tour key for being carried by a guard for use with a security monitoring system of the type wherein a predetermined tour route is defined by a plurality of tour stations spaced therealong for plug-in electrical connection with the tour key and wherein the plurality of tour stations each have a predetermined tour station position code programmed therein, comprising an electrical connector for mating with the tour stations, means connected to said electrical connector for providing a memory output corresponding to each of the predetermined tour station position codes when plug-in electrical connection is made with each of the plurality of tour stations, means for receiving a predetermined number of said memory outputs and for providing a tour information signal in response thereto, whereby plug-in electrical connection at the tour stations in random sequence produces said tour information signal.

29. An electronic tour key for transport by a guard for use with a security monitoring system of the type wherein a predetermined tour route is defined by a plurality of tour stations spaced therealong, the tour stations each having a predetermined tour position code set therein, comprising an electrical connector, memory means for recording the tour position code when electrical plug-in connection is made with one of the plurality of tour stations and providing a plurality of memory outputs, each one of said plurality of memory outputs being related to one of the tour position codes, means for receiving the outputs of said memory, means for providing a tour information signal after electrical plug-in connection with a predetermined number of tour stations, whereby the tour information signal is produced when the tour stations are visited for plug-in electrical connection therewith in a random sequence.

30. An electronic tour key for carrying by a guard for use with a security monitoring system of the type wherein a predetermined tour route has spaced therealong a plurality of tour stations for plug-in electrical connection by the guard in a predetermined sequence, and wherein the tour stations have a predetermined tour position code programmed therein, comprising means for setting a tour length code, a digital counter for receiving said tour length code and providing a digital output, an electrical connector for mating with the tour stations, a digital comparator for receiving said digital output together with the tour position code from the tour station, said digital comparator providing an output determined by the match between the tour position code and the digital output, a match indicator for receiving the output from said digital comparator, said match indicator providing an advance signal to said digital counter upon withdrawing said electrical connector from the tour station so that said tour key must be electrically connected to the next tour station in the predetermined sequence before said digital counter will be advanced.

* * * * *